US006694549B2

(12) United States Patent
Perez et al.

(10) Patent No.: US 6,694,549 B2
(45) Date of Patent: Feb. 24, 2004

(54) BED FRAME WITH REDUCED-SHEAR PIVOT

(75) Inventors: Timothy W. Perez, James Island, SC (US); Sohrab Soltani, Charlesston, SC (US); James J. Romano, James Island, SC (US)

(73) Assignee: Hill-Rom Services, Inc., Wilmington, DE (US)

( * ) Notice: Subject to any disclaimer, the term of this patent is extended or adjusted under 35 U.S.C. 154(b) by 47 days.

(21) Appl. No.: 09/839,090

(22) Filed: Apr. 20, 2001

(65) Prior Publication Data

US 2002/0152551 A1 Oct. 24, 2002

(51) Int. Cl.[7] ..... A61G 7/015
(52) U.S. Cl. ..... 5/618; 5/617; 5/613
(58) Field of Search ..... 5/613, 614, 617, 5/618

(56) References Cited

U.S. PATENT DOCUMENTS

| | | | | |
|---|---|---|---|---|
| RE10,906 | E | 3/1888 | Case | |
| 421,656 | A | 2/1890 | Blanken | |
| 979,461 | A | 12/1910 | Gale | |
| 1,398,203 | A | 11/1921 | Schmidt | |
| 2,136,088 | A | 11/1938 | Stevens | |
| 2,337,395 | A | 12/1943 | Leland | |
| 2,587,291 | A | 2/1952 | Rochers | |
| 2,710,976 | A | 6/1955 | Martensen | |
| 2,722,017 | A | 11/1955 | Burst et al. | |
| 2,747,919 | A | 5/1956 | Ferneau et al. | |
| 2,837,751 | A | 6/1958 | McCall | |
| 2,913,300 | A | 11/1959 | Darnell et al. | |
| 2,951,252 | A | 9/1960 | Roche | |
| 2,956,289 | A | 10/1960 | Sullivan | |
| 3,036,314 | A | 5/1962 | Wetzler | |
| 3,039,119 | A | 6/1962 | Bourgraf et al. | |
| 3,053,568 | A | 9/1962 | Miller | |
| 3,220,021 | A | 11/1965 | Nelson | |
| 3,220,022 | A | 11/1965 | Nelson | |
| 3,281,141 | A | 10/1966 | Smiley et al. | |
| 3,305,877 | A | * 2/1967 | Nielsen | 5/618 |
| 3,319,270 | A | 5/1967 | Greiner | |
| 3,336,606 | A | * 8/1967 | Beitzel | 5/610 |
| 3,353,193 | A | 11/1967 | Greiner | |

(List continued on next page.)

FOREIGN PATENT DOCUMENTS

| | | |
|---|---|---|
| DE | 20 31 471 | 1/1972 |
| DE | 199 00 602 C 1 | 7/2000 |
| EP | 0 037 063 | 10/1981 |
| GB | 1 259 181 | 1/1972 |
| JP | 7124201 | 5/1995 |
| JP | 8280747 | 10/1996 |
| JP | 105284 | 1/1998 |
| NL | 74802 | 3/1954 |
| WO | WO91/07157 | 5/1991 |
| WO | WO 98/17153 | 4/1998 |

OTHER PUBLICATIONS

Hill–Rom, "Med–Surg Bed Accessories", 1997.
"Products for Home Care", http://www.paramount.co.jp/ec/ec01.html, Apr. 19, 2000.
"What's New", http://www.paramount.co.jp/ee/ee.html, Apr. 19, 2000.
Paramount Bed catalogue (date unknown).

*Primary Examiner*—Michael F. Trettel
(74) *Attorney, Agent, or Firm*—Bose McKinney & Evans LLP

(57) ABSTRACT

A patient support is provided having a frame, a deck positioned on the frame, and a mattress. The deck includes a deck section configured to move relative to the frame. The frame includes a recessed portion configured to receive the deck section during movement of the deck section relative to the frame.

43 Claims, 18 Drawing Sheets

U.S. PATENT DOCUMENTS 3,406,772 A 10/1968 Ahrent et al.
3,506,989 A 4/1970 Ross et al.
3,585,659 A 6/1971 Burst et al.
3,593,350 A 7/1971 Knight et al.
3,821,821 A 7/1974 Burst et al.
3,905,591 A 9/1975 Schorr et al.
3,932,903 A 1/1976 Adams et al.
4,097,940 A 7/1978 Tekulve et al.
4,127,906 A 12/1978 Zur
4,139,917 A 2/1979 Fenwick
4,183,015 A 1/1980 Drew et al.
4,183,109 A 1/1980 Howell
4,186,456 A 2/1980 Huempfner
4,215,446 A 8/1980 Mahoney
4,222,131 A 9/1980 Holdt et al.
4,227,269 A 10/1980 Johnston
4,232,415 A 11/1980 Webber
4,312,500 A 1/1982 Janssen
4,376,316 A 3/1983 Mercier et al.
4,380,838 A 4/1983 Lutchansky
4,409,695 A 10/1983 Johnston et al.
4,411,035 A 10/1983 Fenwick
4,439,880 A 4/1984 Koncelik et al.
4,558,857 A 12/1985 Heller
4,559,655 A 12/1985 Peck
4,559,656 A 12/1985 Foster
4,572,573 A 2/1986 Yoshikawa et al.
4,589,151 A * 5/1986 Behrens ..... 5/614
4,592,104 A 6/1986 Foster et al.
4,604,022 A 8/1986 Bourgraf
4,637,652 A 1/1987 Bergenwall
4,653,129 A 3/1987 Kuck et al.
4,654,903 A 4/1987 Chubb et al.
4,676,687 A 6/1987 Koffler
4,685,159 A 8/1987 Oetiker
4,704,750 A 11/1987 Wheelock
4,711,486 A 12/1987 Fujiyama
4,745,647 A 5/1988 Goodwin
4,751,754 A 6/1988 Bailey et al.
4,768,249 A 9/1988 Goodwin
4,827,545 A 5/1989 Arp
4,847,929 A 7/1989 Pupovic
4,862,529 A 9/1989 Peck
4,894,876 A 1/1990 Fenwick
4,912,787 A 4/1990 Bradcovich
4,937,900 A 7/1990 Bridges
4,944,055 A 7/1990 Shainfeld
4,985,946 A 1/1991 Foster et al.
5,035,014 A 7/1991 Blanchard
5,044,025 A 9/1991 Hunsinger et al.
5,072,463 A 12/1991 Willis
5,077,843 A 1/1992 Dale et al.
5,083,332 A 1/1992 Foster et al.
5,083,334 A 1/1992 Huck et al.
5,084,925 A 2/1992 Cook
5,129,117 A 7/1992 Celestina et al.
5,179,744 A 1/1993 Foster et al.
5,191,663 A 3/1993 Holder et al.
5,205,004 A 4/1993 Hayes et al.
5,269,388 A 12/1993 Reichow et al.
5,279,010 A 1/1994 Ferrand et al.
5,317,769 A 6/1994 Weismiller et al.
5,381,571 A 1/1995 Gabhart
5,394,580 A 3/1995 Foster et al.
5,398,357 A 3/1995 Foster
5,402,544 A 4/1995 Crawford et al.
5,454,126 A 10/1995 Foster et al.
5,481,772 A 1/1996 Glynn et al.
5,485,699 A 1/1996 Gabhart
5,537,701 A 7/1996 Elliott
5,577,277 A 11/1996 Sundberg et al.
5,577,279 A 11/1996 Foster et al.
5,671,490 A 9/1997 Wu
5,678,264 A 10/1997 Walker
5,689,839 A 11/1997 Laganiere et al.
5,715,548 A 2/1998 Weismiller et al.
5,732,423 A 3/1998 Weismiller et al.
5,781,945 A 7/1998 Scherer et al.
5,790,997 A 8/1998 Ruehl
5,802,636 A 9/1998 Corbin et al.
5,996,151 A 12/1999 Bartow et al.
6,182,310 B1 2/2001 Weismiller et al.

* cited by examiner

BED FRAME WITH REDUCED-SHEAR PIVOT

BACKGROUND OF THE INVENTION

The present invention relates to a bed, and particularly to a bed that can be manipulated to achieve both a conventional bed position having a horizontal rest surface upon which a person lies in a supine position and a seated position having a back section of the rest surface tilted relative to a seat section of the rest surface.

Many hospital beds are positionable to a configuration having the rest surface of the bed at a predetermined height above the floor and having siderails positioned to restrain the movement of a person lying on the rest surface past sides of the rest surface and off of the bed. The rest surfaces of many such hospital beds can typically be lowered to reduce the distance between the rest surface and the floor, and the rest surfaces of such beds can often be manipulated to adjust the position of the person on the rest surface.

According to the present invention, a patient support is provided that includes a frame, a deck positioned on the frame, and a mattress positioned on the deck. The deck includes a deck section configured to move relative to the frame. The frame includes a recessed portion configured to receive the deck section during movement of the deck section relative to the frame. The recessed portion includes an outer width. The deck section is positioned over the recessed portion of the frame and includes an outer width greater than or equal to the outer width of the recessed portion.

According to another embodiment of the present disclosure, a patient support is provided that includes a frame, an end board, a deck supported by and configured to move relative to the frame, and a mattress positioned on the frame. The frame includes a recessed portion defining a recess and a board support portion coupled to the recessed portion. The end board is coupled to the board support portion of the frame in a substantially vertical position. A portion of the mattress is positioned in the recess during movement of the deck relative to the frame.

According to another embodiment of the present disclosure, a patient support is provided that includes a frame, a deck positioned on the frame, and a mattress positioned on the deck. The deck includes a deck section configured to move between first and second positions relative to the frame. The frame includes a pair of spaced-apart frame members including recessed portions configured to receive the deck section when in the second position. The recessed portions are spaced apart by a first distance. The deck section is positioned above the recessed portion of the spaced-apart frame members and includes an outer width greater than or equal to the first distance.

According to another alternative embodiment of the present invention, a patient support is provided that includes a frame, a deck positioned on the frame, and a mattress positioned on the deck. The frame includes a concave portion defining a recess. The deck includes a deck section configured to move relative to the frame between a first position and second position. The concave portion of the frame is configured to provide clearance for the deck section to move in the recess when moving between the first and second positions.

According to another embodiment of the present invention, a patient support is provided including a frame, a deck positioned on the frame, and a mattress positioned on the deck. The deck includes a first support member, a second support member, and a coupler configured to couple a first end of the first support member to a second end of the second support member. The coupler is configured to coordinate movement of the first and second support members during movement of the first and second support members relative to the frame between first and second positions. The first end of the first support member is spaced apart from the second end of the second support member by a first distance when in the first position. The first end of the first support member is spaced apart from the second end of the second support member by a second distance when in the second position. The second distance is greater than the first distance. The patient support further includes an actuator coupled to the first support member of the deck. The actuator is configured to move the first support member between the first and second positions.

According to another embodiment of the present invention, a patient support is provided that includes a frame, a mattress supported by the frame, and a siderail configured to move relative to the frame. The siderail includes a rail member and a compliant member coupled to the rail member. The rail member and the compliant member cooperate to block egress of a patient from the mattress. The compliant member is configured to move relative to the rail member when the compliant member moves into contact with an object during movement of the siderail relative to the frame.

According to another embodiment of the present invention, a patient support is provided that includes a frame, a mattress supported by the frame, and a siderail configured to move relative to the frame between a first position and a second position. The siderail includes a first rail member and a second rail member coupled to the first rail member. The second rail member cooperates with the first rail member to block egress of a patient from the mattress. The second rail member is spaced apart from an object when the siderail is in the first position. The second rail member contacts the object when in the second position. The second rail member moves relative to the first rail member when the second rail member moves into contact with the object.

According to another embodiment of the present disclosure, a patient support is provided that includes a frame, a mattress supported by the frame, and a siderail configured to move in a direction relative to the frame from a first position to a second position. The siderail includes a first rail member and a second rail member that cooperates with the first rail member to block egress of a patient from the mattress. The first rail member is configured to move in the direction when the siderail moves in the direction. The second rail member is configured to move in the direction when the siderail moves in the direction until contacting an object and ceasing movement in the direction.

Additional features of the present invention will become apparent to those skilled in the art upon consideration of the following detailed description of the presently perceived best mode of carrying out the invention.

BRIEF DESCRIPTION OF THE DRAWINGS

The detailed description particularly refers to the accompanying figures in which.

DETAILED DESCRIPTION OF THE DRAWINGS

Figure 1:
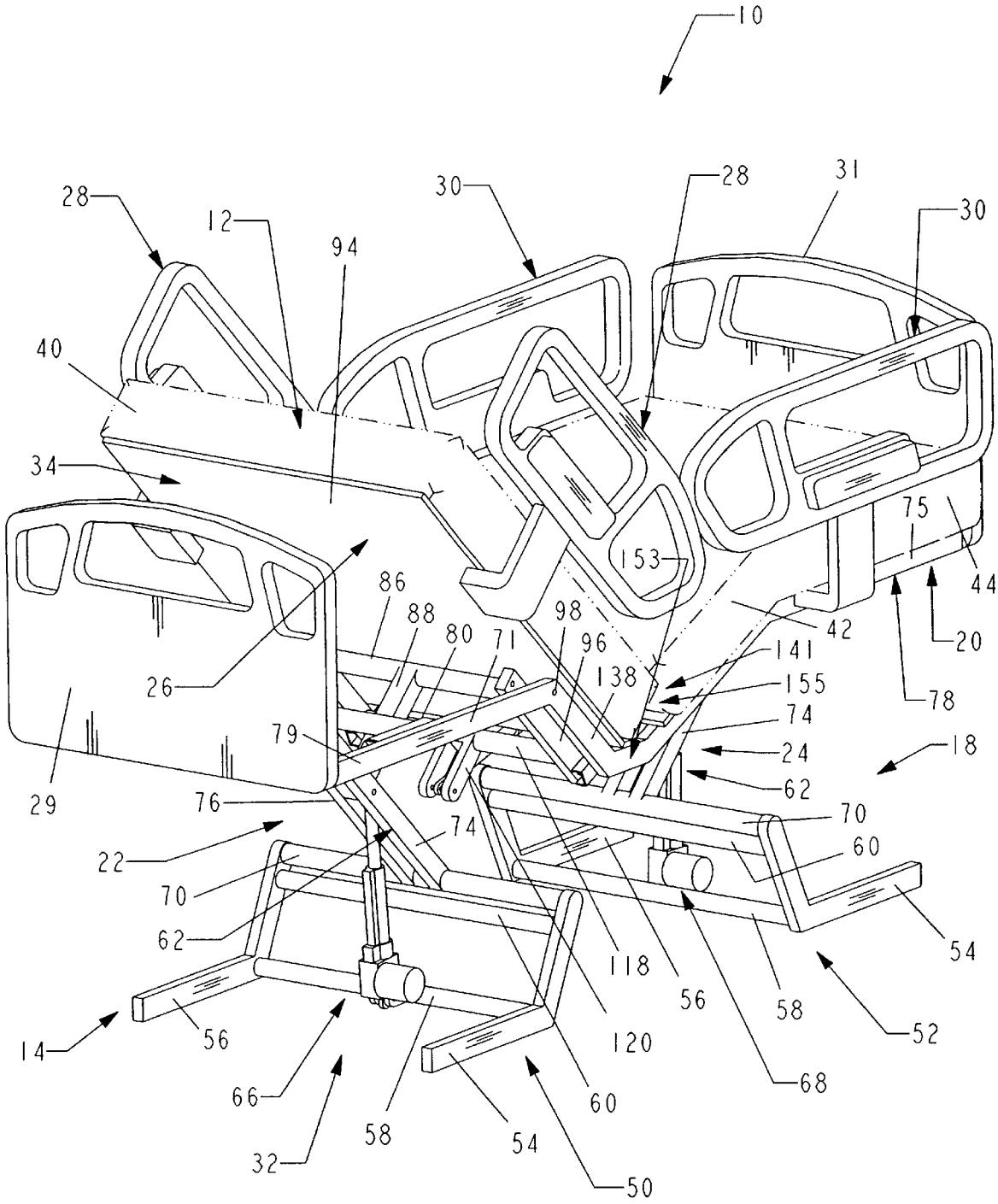
FIG. 1 is a perspective view of a bed in accordance with the present disclosure showing the bed including a bedframe having a two-piece base frame, an intermediate frame, and an articulated deck, a mattress positioned on the articulated deck, a head board coupled to the intermediate frame, a foot board, a pair of head end siderails coupled to a tilted head section of the articulated deck, and a pair of foot end siderails coupled to a horizontal foot section of the deck.

A bed 10 in accordance with a preferred embodiment of the present disclosure is illustrated in FIG. 1. Bed 10 includes a mattress 12 and a bedframe 14 supporting mattress 12 over the floor. Mattress 12 provides a rest or support surface 16 configured to receive a person (not shown). Bedframe 14 includes a base frame 18, an intermediate frame 20, a pair of lift arms 22, 24 coupling intermediate frame 20 to base frame 18, and an articulated deck 26 positioned between mattress 12 and intermediate frame 20. Head and foot end siderails 28, 30 are coupled to articulated deck 26. A headboard 29 and a footboard 31 are coupled to opposite head and foot ends of intermediate frame 20.

Bed 10 can be manipulated by a caregiver or by a person (not shown) on rest surface 16 using a hydraulic system 32 so that mattress 12, intermediate frame 20, and articulated deck 26 assume a variety of positions. Articulated deck 26 includes a head section 34, a seat section 36, and a foot section 38. Mattress 12 rests on deck 26 and includes a head portion 40, a seat portion 42, and a foot portion 44, each of which generally corresponds to the like-named portions of deck 26, and each of which is generally associated with the head, seat, and feet of the person on rest surface 16.

Figure 3:
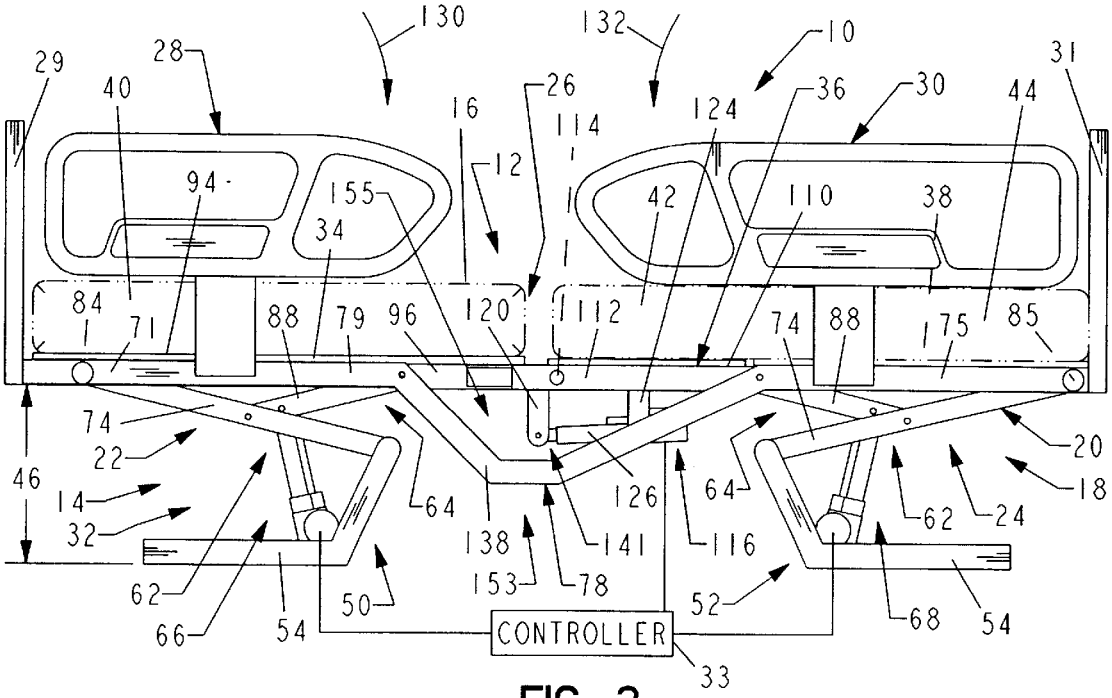
FIG. 3 is a side elevation view of the bed of FIG. 1 showing the intermediate frame in a lowered position and the articulated deck in a substantially flat bed position.

As shown in FIG. 3, bed 10 can assume a bed position having deck 26 configured so that rest surface 16 is planar and horizontal. In a low position, intermediate frame 20 is a predetermined first distance 46 above the floor as shown in FIG. 3. Bed 10 can also be manipulated to assume a high position shown in FIG. 4 with intermediate frame 20 a predetermined second distance 48 above the floor, the second distance 48 being greater than first distance 46.

Bed 10 can be moved to a Trendelenburg position (not shown) having deck 26 in a planar configuration and tilted so a head end of rest surface 16 is positioned closer to the floor than a foot end of rest surface 16. Bed 10 can also achieve a Reverse Trendelenburg position (not shown) having deck 26 in a planar configuration and tilted so that the foot end of rest surface 16 is positioned closer to the floor than the head end of rest surface 16.

Figure 2:
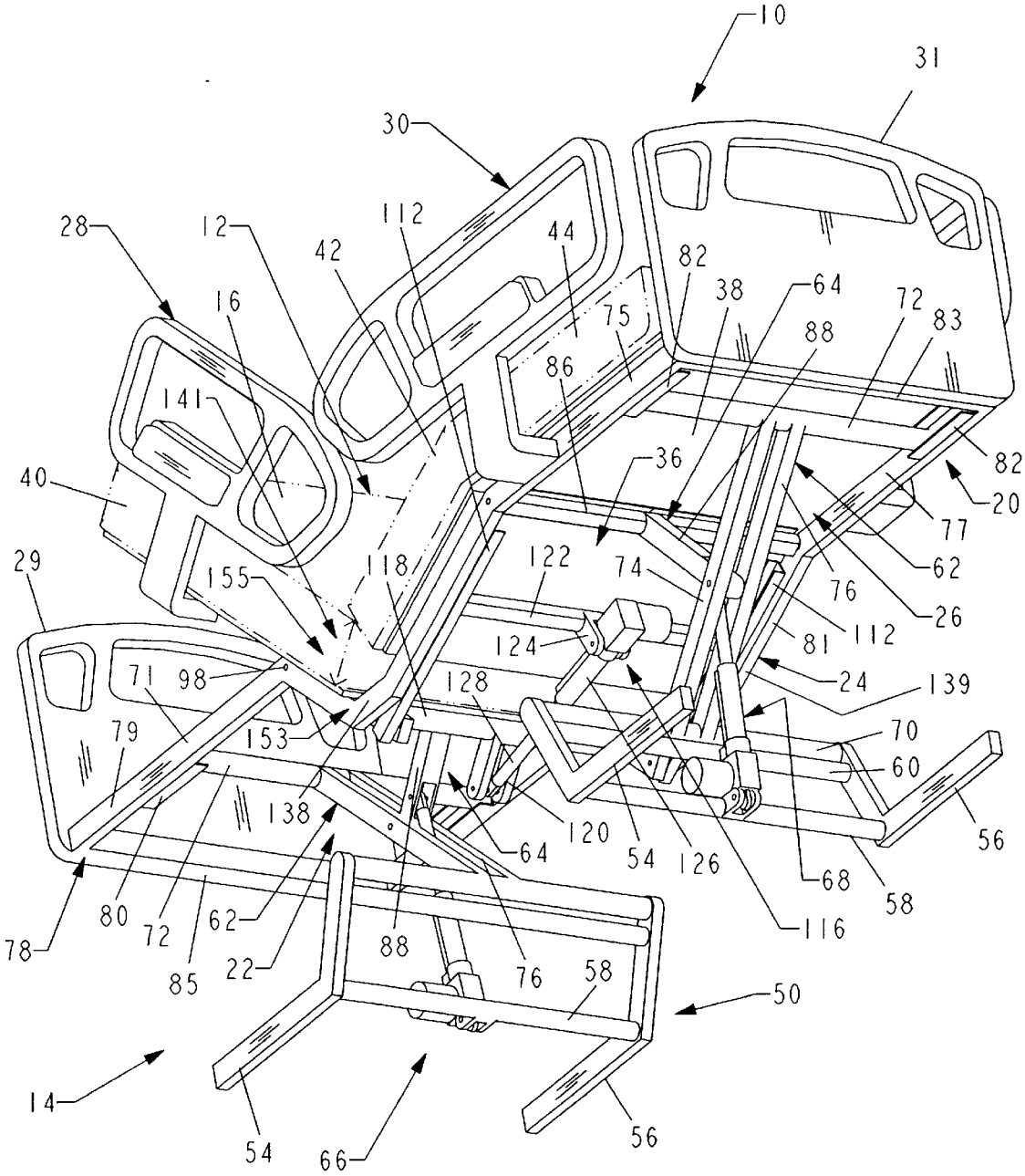
FIG. 2 is a perspective view of the bed of FIG. 1 showing the bedframe including a pair of lift arms extending between the base frame and the intermediate frame.
Figure 4:
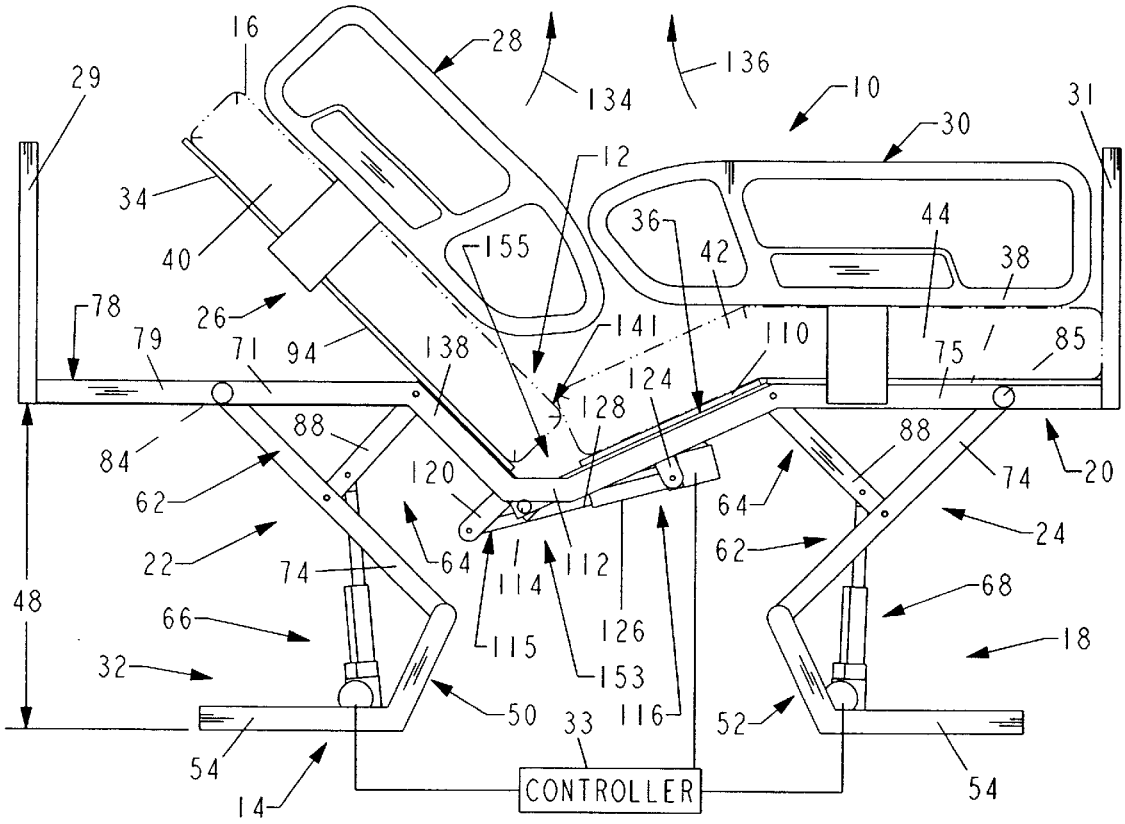
FIG. 4 is a view similar to FIG. 3 showing the intermediate frame in a raised position and the articulated deck in a seated position with head and seat sections of the articulated deck tilted relative to the intermediate frame.

Bed 10 is convertible to a seated position shown in FIGS. 1, 2, and 4. In the seated position, the head end of head section 34 of deck 26 is pivoted upwardly away from the head end of intermediate frame 20 to a back-support position providing a pivotable backrest for a person positioned on rest surface 16. Seat section 36 of deck 26 is pivoted downwardly to a seat-support position providing a pivotably seat for a person positioned on rest surface 16. Foot section 38 of deck 26 remains generally horizontal during movement of head and seat sections 34, 36. Bed 10 is also capable of assuming positions in which head and seat sections 34, 36 of deck 26 are in positions intermediate to those shown in FIGS. 3 and 4. According to alternative embodiments of the present disclosure, the foot section tilts relative to the intermediate frame during movement of the head and seat sections of the deck.

Base frame 18 includes a pair of spaced-apart feet 50, 52 normally positioned on the floor. Lift arms 22, 24 are coupled to respective feet 50, 52 and intermediate frame 20 as shown in FIGS. 2–4. Lift arms 22, 24 are configured to raise and lower intermediate frame 20 between the low and high positions relative to feet 50, 52. According to alternative embodiments of the present disclosure, the base frame includes a unitary frame member and the lift arms are coupled to the unitary frame member.

Each foot 50, 52 includes a pair of angled members 54, 56 and a pair of struts 58, 60 extending between angled members 54, 56. Each lift arm 22, 24 includes a first link 62 and a second link 64. Each first link 62 is slidably coupled to intermediate frame 20 and pivotably coupled to respective angled members 54, 56. Each second link 64 is pivotably coupled to intermediate frame 20 and pivotably coupled to respective first links 62 as shown in FIG. 2.

As shown in FIG. 2, each first link 64 includes a lower horizontal strut 70 pivotably coupled to respective angled member 54, 56, an upper horizontal strut 72 slidably coupled to intermediate frame 20, and pair of spaced-apart first and second bars 74, 76 extending between and rigidly coupled to respective upper and lower struts 70, 72. Intermediate frame 20 includes a substantially rectangular frame member 78, a first pair of channel members 80 coupled to a head end of frame member 78, and a second pair of channel members 82 coupled to a foot end of frame member 78 as shown in FIG. 2. Channel members 80 receive rollers 84 coupled to distal ends of upper horizontal strut 72 of lift arm 22. Similarly, channel members 82 receive rollers 85 coupled to distal ends of upper horizontal strut 72 of lift arm 24.

Each second link 64 includes an upper horizontal strut 86 pivotably coupled to intermediate frame 20 and a bar 88 pivotably coupled to respective first and second bars 74, 76 by a pin 90 located at the midpoint thereof. Bars 88 are rigidly coupled to respective horizontal struts 86.

Hydraulic system 32 is provided to power and control the movement of bed 10. Hydraulic system 32 includes a head end actuator 66 pivotably coupled to strut 58 of foot 50 and second link 64 of arm 22 and a foot end actuator 68 pivotably coupled to strut 58 of foot 52 and second link 64 of arm 24. Head end actuator 66 is pivotably coupled to bar 88 of lift arm 22 and foot end actuator 68 is pivotably coupled to bar 88 of lift arm 24 as shown in FIGS. 3 and 4.

Hydraulic system 32 further includes a controller 33 configured to regulate the operation of head and foot end actuators 66, 68. According to the preferred embodiment of the present disclosure, controller 33 includes a plurality of buttons or other command-receiving devices (not shown) for receiving commands from a patient positioned on bed 10 or a caregiver. Controller 33 is configured to automatically control the extension and retraction of head and foot end actuators 66, 68 when a patient or caregiver selects a given position for intermediate frame 20 as is discussed in greater detail below.

Head end actuator 66 is configured to provided the power to raise and lower the head end of intermediate frame 20. Similarly, foot end actuator 68 is configured to provide the power to raise and lower the foot end of intermediate frame 20. Preferably actuators 66, 68 are hydraulic cylinders. It will be appreciated, however, that in accordance with the present disclosure, various mechanical and electromechanical actuators and drivers may be used to raise and lower intermediate frame 20.

The caregiver can adjust the height of rest surface 16, as shown in FIGS. 3 and 4, by activating actuators 66, 68 with controller 33 to power movement of lift arms 22, 24. When bed 10 is in the raised position, lift arms 22, 24 are in the raised position shown in FIG. 4 having actuators 66, 68 extended to push up on bars 88. To lower intermediate frame 20, actuators 66, 68 are retracted to permit bars 88 and intermediate frame 20 to lower. As actuators 66, 68 retract, rollers 84, 85 of first and second lift arms 20, 24 ride in respective channel members 80, 82 toward respective headboard 29 and footboard 31. Actuators 66, 68 can be retracted and extended when bed 10 is in either the bed or seated positions and can be operated independently to move intermediate frame 20 to the Trendelenburg or Reverse Trendelenburg positions.

According to alternative embodiments of the present disclosure, the actuators are coupled to other locations and components of the lift arms, base frame, and/or intermediate frame to change the positions of these components relative to one another to lift and lower the intermediate frame. For example, according to one alternative embodiment of the present disclosure, the actuators are coupled to the feet and the junction of the first and second links of the lift arms. According to another alternative embodiment of the present disclosure, the actuators are coupled to the feet and the first link of the lift arms. According to yet another embodiment, the actuators are coupled between the first and second links of the lift arms.

According to alternative embodiments of the present disclosure, other configurations of lift mechanisms and base frames are used to raise and lower the intermediate frame. For example, the lift mechanisms disclosed in U.S. Pat. No. 5,878,452, to Brooke et al.; U.S. Pat. No. 5,715,548, to Weismiller et at.; U.S. Pat. No. 5,708,997, to Foster et al.; U.S. Pat. No. 5,613,255, to Bish et al.; U.S. Pat. No. 5,117,521, to Foster et al.; U.S. Pat. 4,025,972, to Adams et al.; and U.S. Pat. No. 3,932,903, to Adams et al. (the disclosures of which are expressly incorporated by reference herein) or any other lift mechanism known to those of ordinary skill in the art may be used.

As previously mentioned, mattress 12 rests on head section 34, seat section 36, and foot section 38 of articulated deck 26 as shown in FIGS. 1–4. Head and seat sections 34, 36 of articulated deck 26 are movable to change the position of a person supported on rest surface 16 of mattress 12. Head section 34 and seat section 36 may be rotated to change the angle of inclination of the back and thighs of the person (not shown) with respect to intermediate frame 20. Head and seat sections 34, 36 cooperate to provide a "reduced-shear pivot" which is the movement produced by a connection between head and seat sections 34, 36 to be described hereinafter. Foot section 38 remains generally horizontal, so that head and seat portions 40, 42 of mattress 12 move relative to foot portion 44 of mattress 12 and relative to each other.

Head section 34 includes a support member or deck panel 94 and a pair of bars 96 rigidly coupled to deck panel 94. Bars 96, and therefore panel 94, are pivotably coupled to intermediate frame 20 by a pair of pins 98. Seat section 36 includes a support member or deck panel 110 and a pair of channel members 112 rigidly coupled to deck panel 94. Deck panel 110 is pivotably coupled to foot section 38 by a hinge 113.

As shown in FIGS. 3 and 4, frame 10 has a concave or recessed portion 153 defining a recess 155 configured to receive deck panels 94, 110 and portions of mattress 12 during movement of deck sections 34, 36 between the bed and seated positions. Recess 155 provides clearance in which deck sections 34, 36 can travel during this movement. When deck sections 34, 36 are in the seated positions, portions of deck sections 34, 36 and mattress 12 are positioned below portions of frame member 78.

Figure 6:
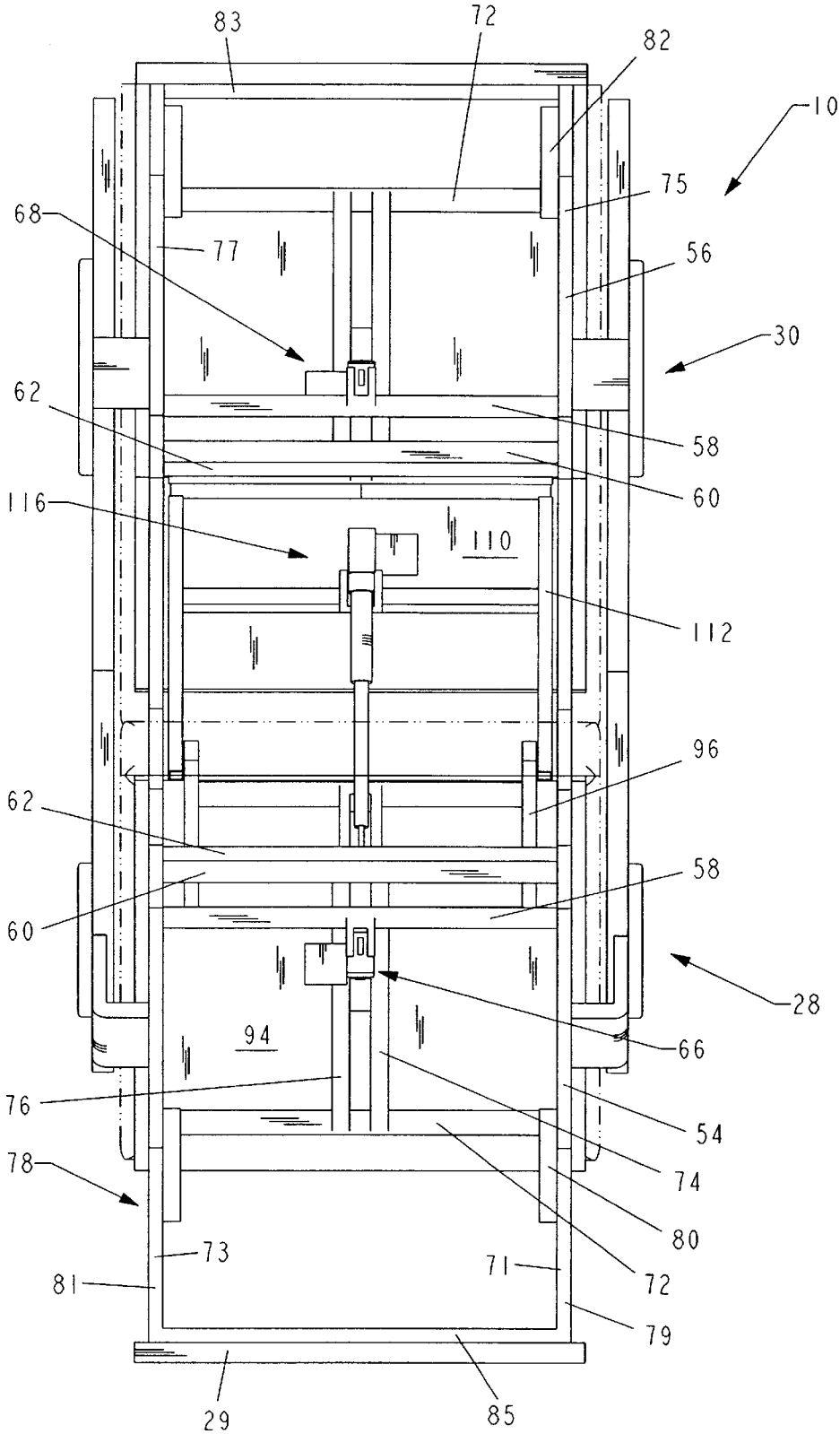
FIG. 6 is a bottom view of the bed of FIG. 1.

Frame member 78 of intermediate frame 20 includes a pair of longitudinally extending frame members 79, 81 and a pair of transversely extending frame members 83, 85 extending between longitudinally extending frame members 79, 81 as shown in FIG. 6. Longitudinally extending frame members 79, 81 include concave or recessed portions 138, 139 that define recessed portion 153 of frame 10 and board support portions 71, 73, 75, 77. Recessed portions 138, 139 are positioned between and extend down from board support portions 71, 73, 75, 77. Board support portions 71, 73, 75, 77 extend substantially horizontally and support headboard 29 and footboard 31. According to an alternative embodiment of the disclosure, the intermediate frame includes fewer or more longitudinally extending and transversely extending frame members.

Figure 7:
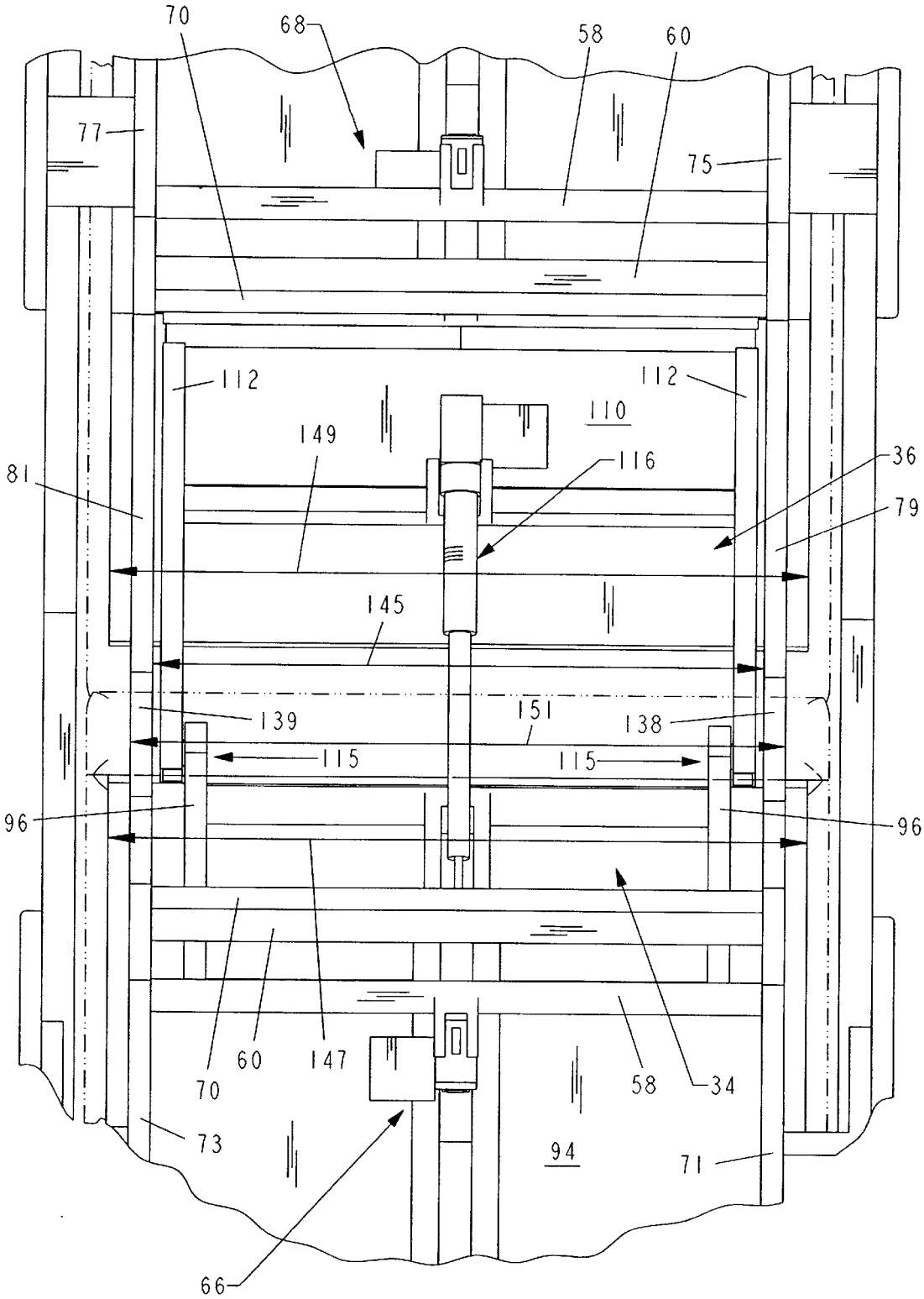
FIG. 7 is an enlarged bottom view of the bed of FIG. 1.

Recessed portions 138, 139 are concave and define recesses 141, 143 that provide clearance for the travel of head and seat sections 34, 36 during movement between the bed and seated positions. As shown in FIG. 2, deck sections 34, 36 are positioned over recessed portions 138, 139 and have widths 147, 149 that are greater than or equal to outer width 151 of recessed portions 153, 138, 139 as shown in FIG. 7 so that deck 26 overhangs recessed portions 153, 138, 139 of intermediate frame 20. Longitudinally extending frame members 79, 81 are spaced apart by an internal distance 145 that is less than widths 147, 149 of deck panels 94, 110. Thus, longitudinally extending frame members 79, 81 block movement of panels 94, 110 beyond the position shown in FIGS. 1, 2, 4, and 5. Similarly, longitudinally extending frame members 79, 81 define an outer width 151 that is less than widths 147, 149 of deck panels 94, 110.

According to alternative embodiments of the present disclosure, other configurations of intermediate frames are provided. For example, according to one embodiment of the present disclosure, the intermediate frame is provided that is wider than the mattress and does not have recessed portions. Because the intermediate frame is wider than the mattress, the head and deck sections have enough clearance to move between the bed and chair positions. According to another alternative embodiment of the present disclosure, the deck sections are coupled to posts that elevate the deck above the intermediate frame to provided clearance for the head and deck sections during movement between the bed and seated positions.

Figure 5:
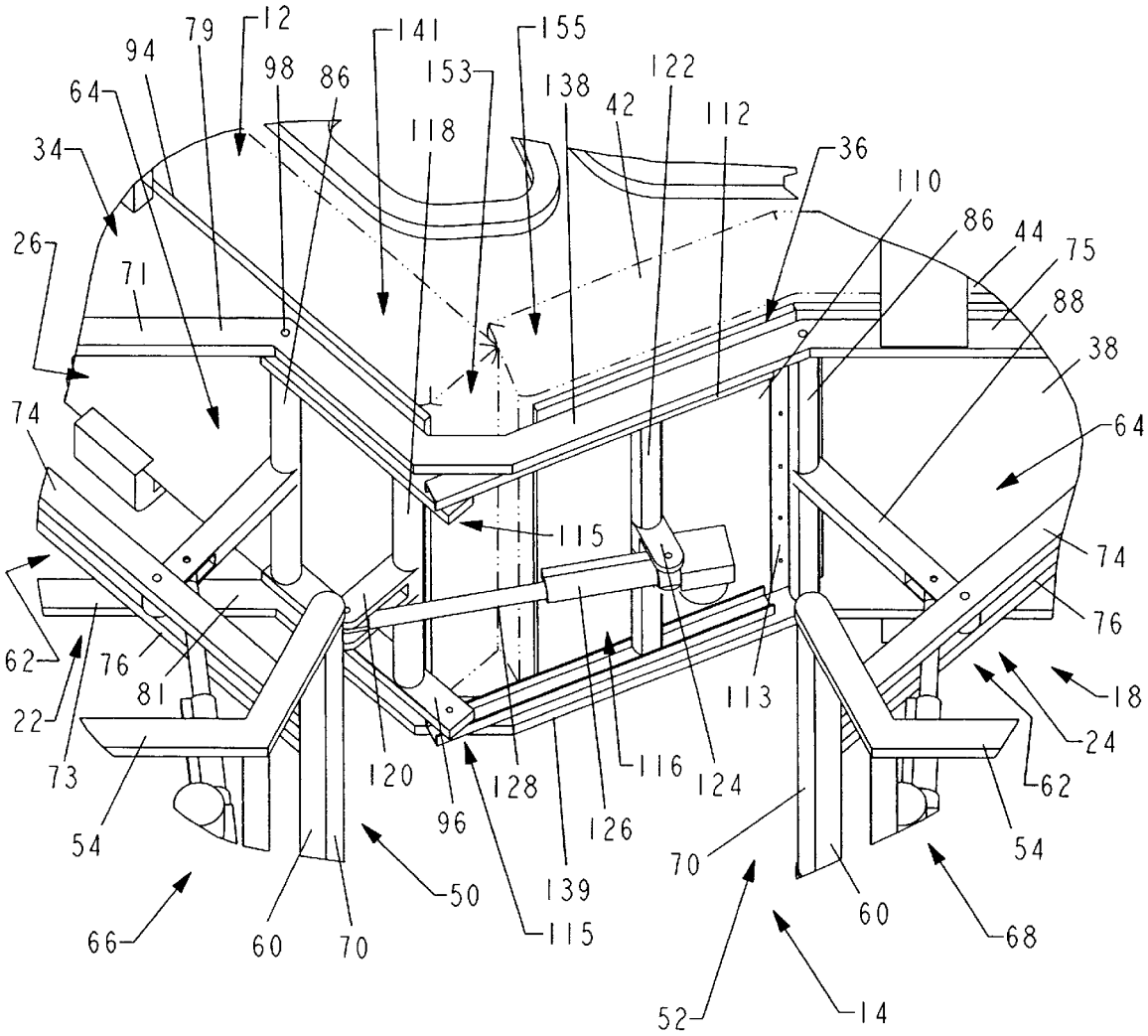
FIG. 5 is a partial perspective view of the bed of FIG. 1 showing the connection between the head and seat sections of the articulated deck.

Bars 96 and channel members 112 extend beyond respective deck panels 94, 110 and cooperate to define a coupler 115 as shown in FIG. 5 that couples deck panels 94, 110 together. Rollers 114 are provided on the distal ends of bars 96 and are positioned to ride in channel members 112 so that head and seat sections 34, 36 of deck 26 are pivotably and slidably coupled together. According to an alternative embodiment of the present disclosure, the channel members are provided on the head section of the deck and the rollers are provided on the seat section of the deck. According to alterative embodiments of the present disclosure, other configurations that provide sliding and/or pivoting between the head and seat sections are possible. For example, pins in slots, tabs in channels, bearings, or any other configurations known to those of ordinary skill in the art to provide sliding and/or pivoting may be used.

Hydraulic system 32 further includes a deck section actuator 116 pivotably coupled to head section 34 and pivotably coupled to seat section 36 as shown in FIG. 5. Deck section actuator 116 is configured to provide power to move head and seat sections 34, 36 between the bed and seated positions and is controlled by controller 33. Preferably, deck section actuator 116 is hydraulic. It will be appreciated, however, that in accordance with the present disclosure, various mechanical and electro-mechanical actuators and drivers may be used to move head and seat sections 34, 36.

As shown in FIG. 5, head section 34 of deck 26 further includes a strut 118 rigidly coupled to bars 96 and a bracket 120 rigidly coupled to strut 118. Similarly, seat section 36 includes a strut 122 rigidly coupled to channel members 112 and a bracket 124 rigidly coupled to strut 122. Deck section actuator 116 includes a cylinder body 126 pivotably coupled to bracket 124 of seat section 36 and a piston rod 128 pivotably coupled to bracket 120 of head section 34.

To move rest surface 16 from the bed position, as shown in FIG. 3, to the seated position, as shown in FIG. 4, actuator 116 is extended. During this extension, piston rod 128 pushes a foot end of head section 34 away from a head end of seat section 36. Because head section 34 is restrained by pins 98 and seat section 36 is likewise restrained by hinge 113, head section 34 pivots in a clockwise direction 130 and seat section 36 pivots in a counterclockwise direction 132. Thus, as rest surface 16 from the bed position to the seated position, a distance between the foot end of head section 34 and the head end of seat section 36 increases.

Because rollers 114 are constrained to move in channel members 112, the angular position of head section 34 relative to seat section 36 is likewise constrained to follow a predetermined relationship with the extension of cylinder 116. Thus, when deck section actuator 116 is in the fully extended position, head section 34 is at a predetermined angle of 45° relative to the floor and seat section 36 is at a predetermined angle of 25° relative to the floor. According to alternative embodiments of the present disclosure, the head and seat sections are tilted at other angles.

To move deck 26 back to the bed position, deck section actuator 116 is moved to the retracted position. This retraction pulls the foot end of head section 34 and the head end of seat section 36 together and narrows the gap therebetween. As head and seat sections 34, 36 move closer together, head section 34 rotates in a counterclockwise direction 134 and seat section 36 rotates in a clockwise direction 136 until both head and seat sections 34, 36 are substantially parallel to the floor. Actuator 116 may also be activated to move head and seat sections 34, 36 to positions intermediate those shown in FIGS. 3 and 4.

As shown in FIGS. 3 and 4, frame member 78 of intermediate frame 20 includes a pair of notched portions 138. Notched portions 138 provide clearance for the travel of head and seat sections 34, 36 during movement between the bed and seated positions. According to alternative embodiments of the present disclosure, other configurations of intermediate frames are provided. For example, according to one embodiment of the present disclosure, the intermediate frame is provided that is wider than the mattress and does not have notched portions. Because the intermediate frame is wider than the mattress, the head and deck sections have enough clearance to move between the bed and chair positions. According to another alternative embodiment of the present disclosure, the deck sections are coupled to posts that elevate the deck above the intermediate frame to provided clearance for the head and deck sections during movement between the bed and seated positions.

Figure 8:
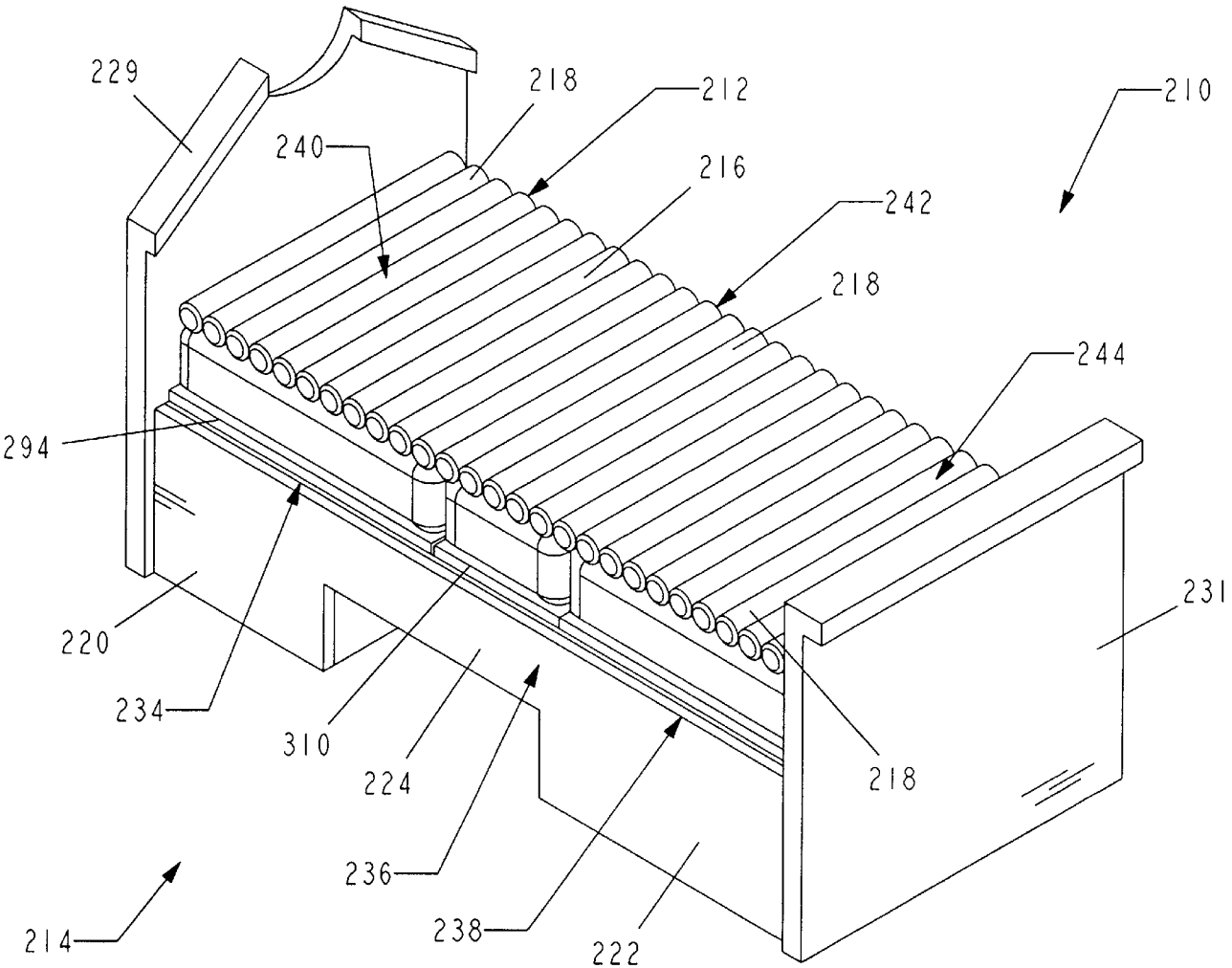
FIG. 8 is a perspective view of another bed in accordance with the present disclosure showing the bed including a base, a mattress positioned over the base, a head board coupled to base, and a foot board coupled to the base.
Figure 11:
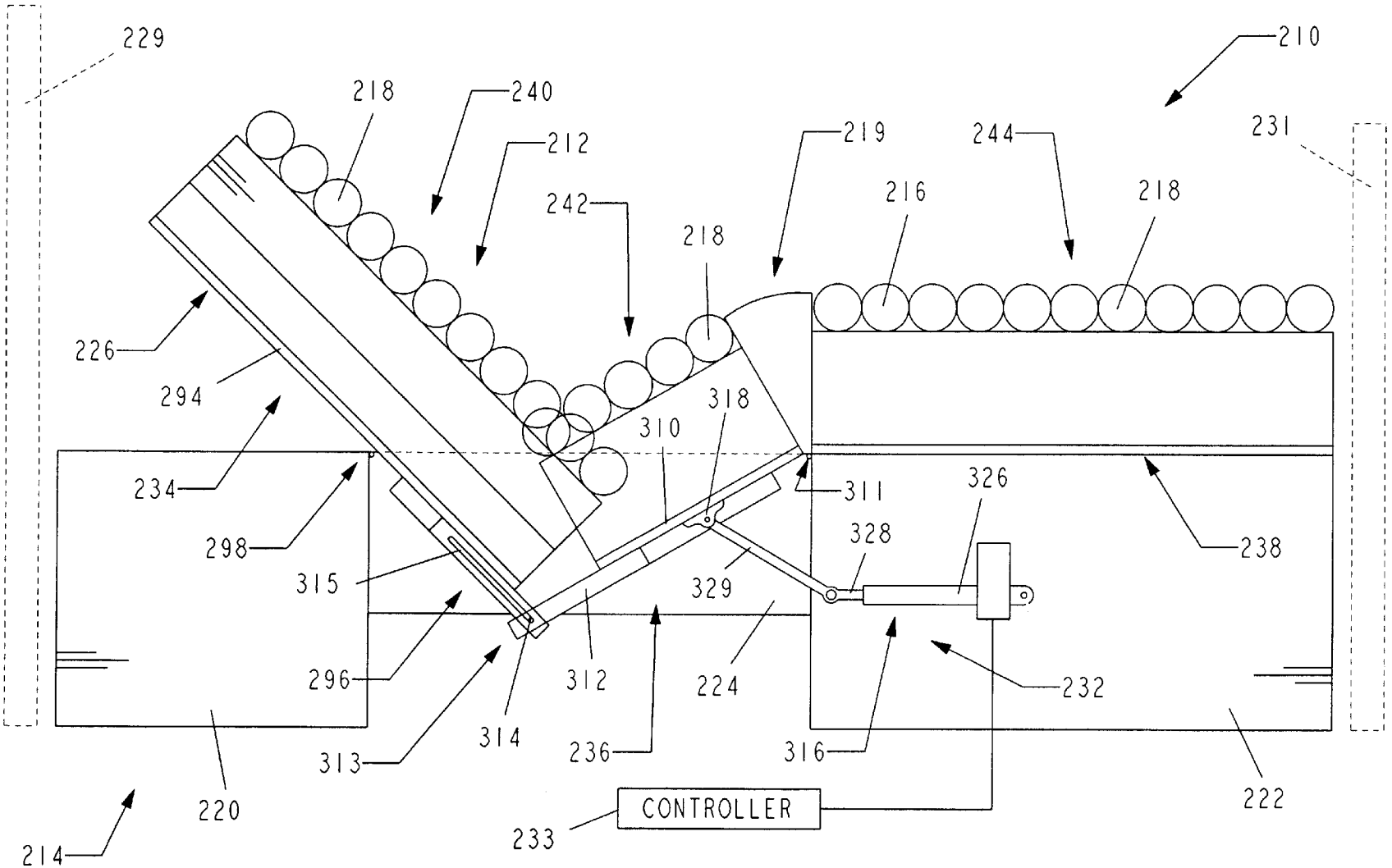
FIG. 11 is a view similar to FIG. 10 showing the articulated deck in the seated position.

A bed 210 in accordance with an alternative embodiment of the present disclosure is illustrated in FIG. 8. Bed 210 includes a mattress 212 and a base 214 supporting mattress 212 over the floor. Mattress 212 includes a plurality of cylinder-shaped fluidized bladders 218 that define a rest or support surface 216 configured to receive a person (not shown). Base 214 includes a pair of columns 220, 222 and a platform 224. As shown in FIG. 11, bed 210 further includes an articulated deck 226 positioned between mattress 212 and platform 224. A headboard 229 and a footboard 231 are coupled to opposite columns 220, 222.

Bed 210 can be manipulated by a caregiver or by a person (not shown) on rest surface 216 using a hydraulic system 232 so that articulated deck 226 and mattress 212 can assume a variety of positions. Articulated deck 226 includes a head section 234, a seat section 236, and a foot section 238. Mattress 212 rests on deck 226 and includes a head portion 240, a seat portion 242, and a foot portion 244, each of which generally corresponds to the like-named portions of deck 226, and each of which is generally associated with the head, seat, and feet of the person on rest surface 216.

Figure 9:
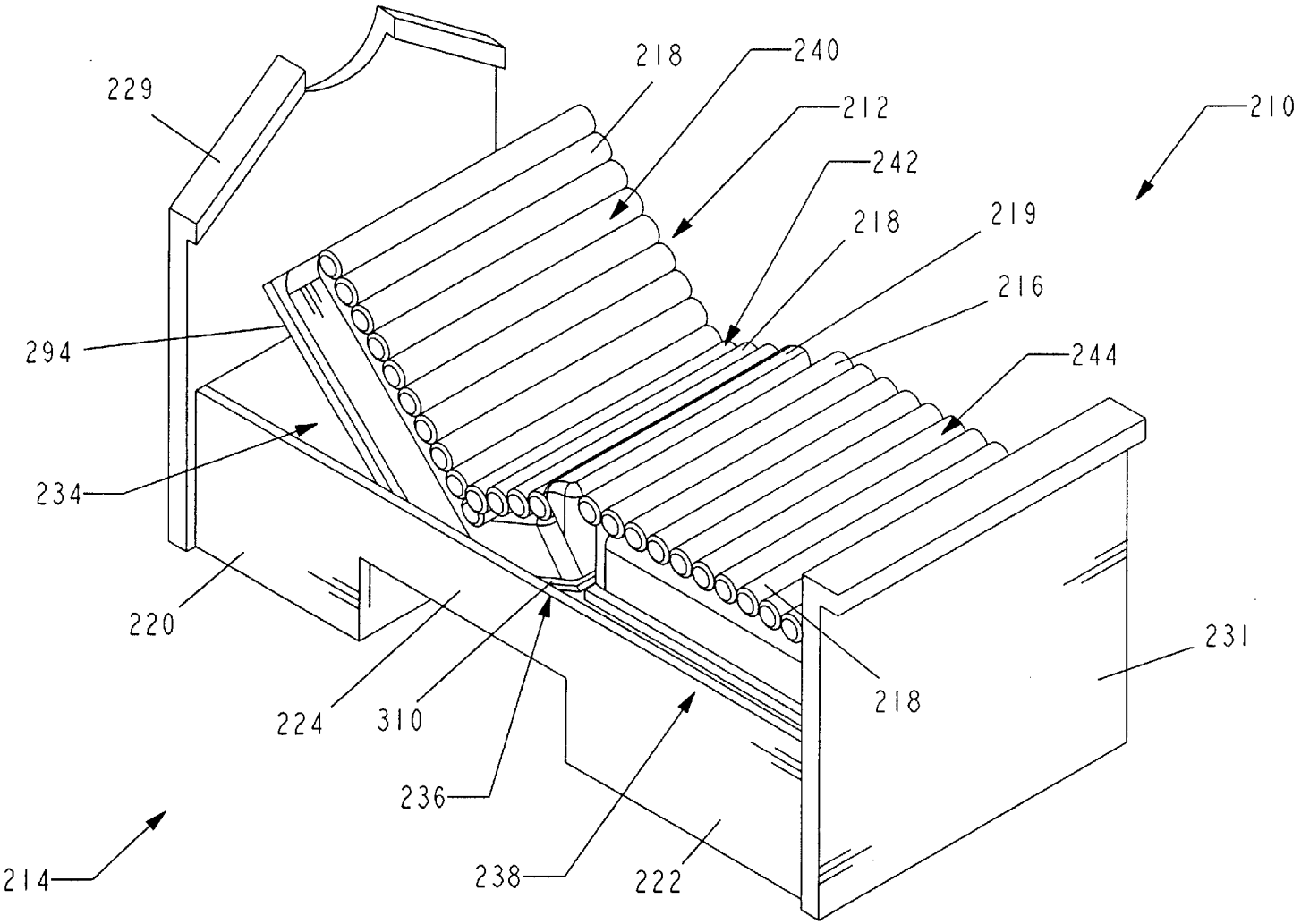
FIG. 9 is a perspective view of the bed of FIG. 8 showing the bed further including an articulated deck in a seated position supporting the mattress.
Figure 10:
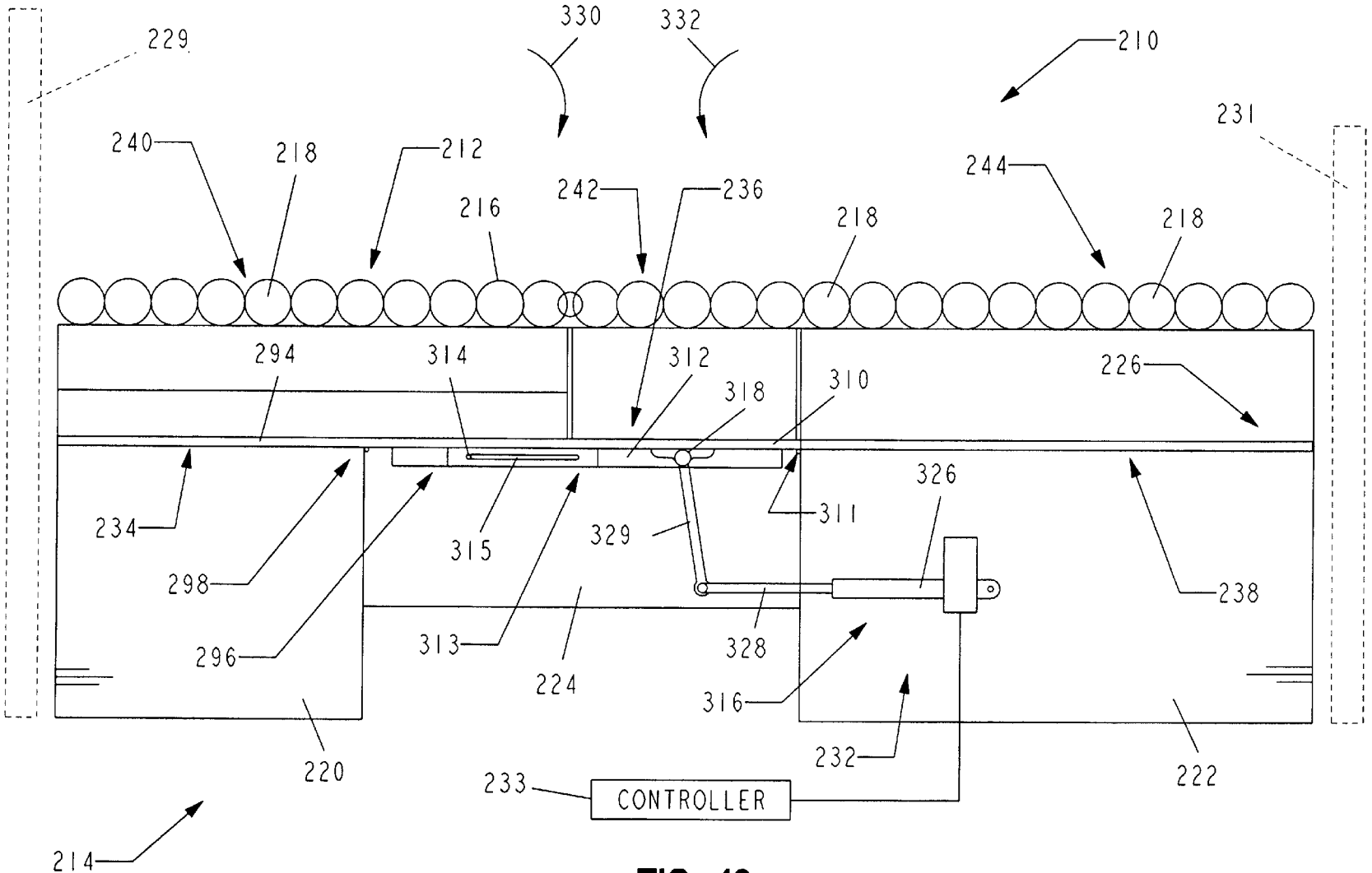
FIG. 10 is a side elevation view of the bed of FIG. 8 showing the deck in a substantially flat position supporting the mattress in a bed position.

As shown in FIGS. 8 and 10, bed 210 can assume a bed position having deck 226 configured so that rest surface 216 is planar and horizontal. Bed 10 is convertible to a seated position shown in FIGS. 9 and 11. In the seated position, the head end of head section 234 of deck 226 is pivoted upwardly away from platform 224 to a back-support position providing a pivotable backrest for a person positioned on rest surface 216. Seat section 236 of deck 226 is pivoted downwardly toward the floor to a seat-support position providing a pivotably seat for a person positioned on rest surface 216. Foot section 238 of deck 226 extends generally horizontally from seat section 236. Bed 210 is also capable of assuming positions in which head and seat sections 234, 236 of deck 226 are in positions intermediate to those shown in FIGS. 10 and 11.

Head and seat sections 234, 236 cooperate to provide a "reduced-shear pivot" between head and seat sections 234, 236 to be described hereinafter. Foot section 238 remains horizontal, so that head and seat portions 240, 242 of mattress 212 move relative to foot portion 244 of mattress 212 and relative to each other.

Head section 234 includes a support member or deck panel 294 and a pair of slotted bars 296 (only one is shown in FIGS. 10 and 11) rigidly coupled to deck panel 294. Bars 296, and therefore panel 294, are pivotably coupled to platform 224 by hinges 298. Seat section 236 includes a support member or deck panel 310 pivotably coupled to platform 224 by hinges 311 and a pair of bars 312 (only one is shown in FIGS. 10 and 11) rigidly coupled to deck panel 294. Bars 296, 312 extend beyond respective deck panels 294, 310 and cooperate to define a coupler 313 that couples deck panels 294, 310 together as shown in FIG. 11. Pins 314 are provided on the distal ends of bars 296 and positioned to ride in slots 315 formed in bars 312 so that head and seat sections 234, 236 of deck 226 are pivotably and slidably coupled together. According to an alternative embodiment of the present disclosure, the slots are provided on the seat section of the deck and the pins are provided on the head section of the deck.

Hydraulic system 232 includes a deck section actuator 316 rigidly coupled to column 222 and pivotably coupled to seat section 236 as shown in FIGS. 10 and 11. Deck section actuator 316 is configured to provide power to move head and seat sections 234, 236 between the bed and seated positions.

Hydraulic system 232 further includes a controller 233 configured to control extension and retraction of deck section actuator 316. According to the preferred embodiment of the present disclosure, controller 233 includes a plurality of buttons or other command-receiving devices (not shown) for receiving commands from a patient positioned on bed 210 or a caregiver. Controller 233 is configured to automatically control the extension and retraction of deck section actuator 316 when a patient or caregiver selects a given position for deck 326 as is discussed in greater detail below.

Preferably, deck section actuator 316 is hydraulic. It will be appreciated, however, that in accordance with the present disclosure, various mechanical and electro-mechanical actuators and drivers may be used to move head and seat sections 234, 236.

As shown in FIG. 10, seat section 236 further includes a flange 318 rigidly coupled to deck panel 310. Deck section actuator 316 includes a cylinder body 326 rigidly coupled to column 222 and a piston rod 328. Another rod 329 is provided that is pivotably coupled to flange 318 of seat section 236 and piston rod 328.

To move rest surface 216 from the bed position, as shown in FIG. 10, to the seated position, as shown in FIG. 11, actuator 316 is retracted. During this retraction, piston rod 328 pulls a head end of seat section 236 away from a foot end of head section 234. Because head section 234 is restrained by hinges 298 and seat section 236 is likewise restrained by hinges 311, head section 234 pivots in a clockwise direction 330 and seat section 236 pivots in a counterclockwise direction 332.

Because pins 314 are constrained to move in slots 315 of bars 312, the angular position of head section 234 relative to seat section 236 is likewise constrained to follow a predetermined relationship with the extension of actuator 316. Thus, when deck section actuator 316 is in the fully contracted position, head section 234 is at a predetermined angle of 45° relative to the floor and seat section 236 is at a predetermined angle of 30° relative to the floor.

To move deck 226 back to the bed position, deck section actuator 316 is moved to the extended position. This extension pushes the head end of seat section 236 and the foot end of head section 234 together and narrows the gap therebetween. As head and seat sections 234, 236 move closer together, head section 234 rotates in a counterclockwise direction 334 and seat section 236 rotates in a clockwise direction 336 until both head and seat sections 234, 236 are substantially parallel to the floor. Actuator 316 may also be activated to move head and seat sections 234, 236 to positions intermediate those shown in FIGS. 10 and 11.

As shown in FIGS. 9 and 11, mattress 212 further includes an inflatable wedge-shaped bladder 219. Bladder 219 is positioned between seat and foot portions 242, 244 of mattress 212. When bed 210 is in the bed position, bladder 219 is deflated. As bed 210 moves to the seated position, bladder 219 is inflated to fill the gap that develops between seat and foot portions 242, 244 of mattress 212 as shown in FIG. 11. As bed 210 is moved back to the bed position, bladder 219 is deflated to provide clearance for seat and foot portions 242, 244 to move back together as shown in FIG. 10.

As shown in FIG. 9, platform 224 is wider than head and seat sections 234, 236 and mattress 212. This difference in widths provides clearance for the travel of head and seat sections 234, 236 during movement between the bed and seated positions. According to alternative embodiments of the present disclosure, other configurations of platforms are provided. For example, according to one embodiment of the present disclosure, the platform is provided with a notch deep enough to receive the head and seat sections when in the seated position. According to another alternative embodiment of the present disclosure, the deck sections are coupled to posts that elevate the deck above the platform to provided clearance for the head and deck sections during movement between the bed and chair positions.

Figure 12:
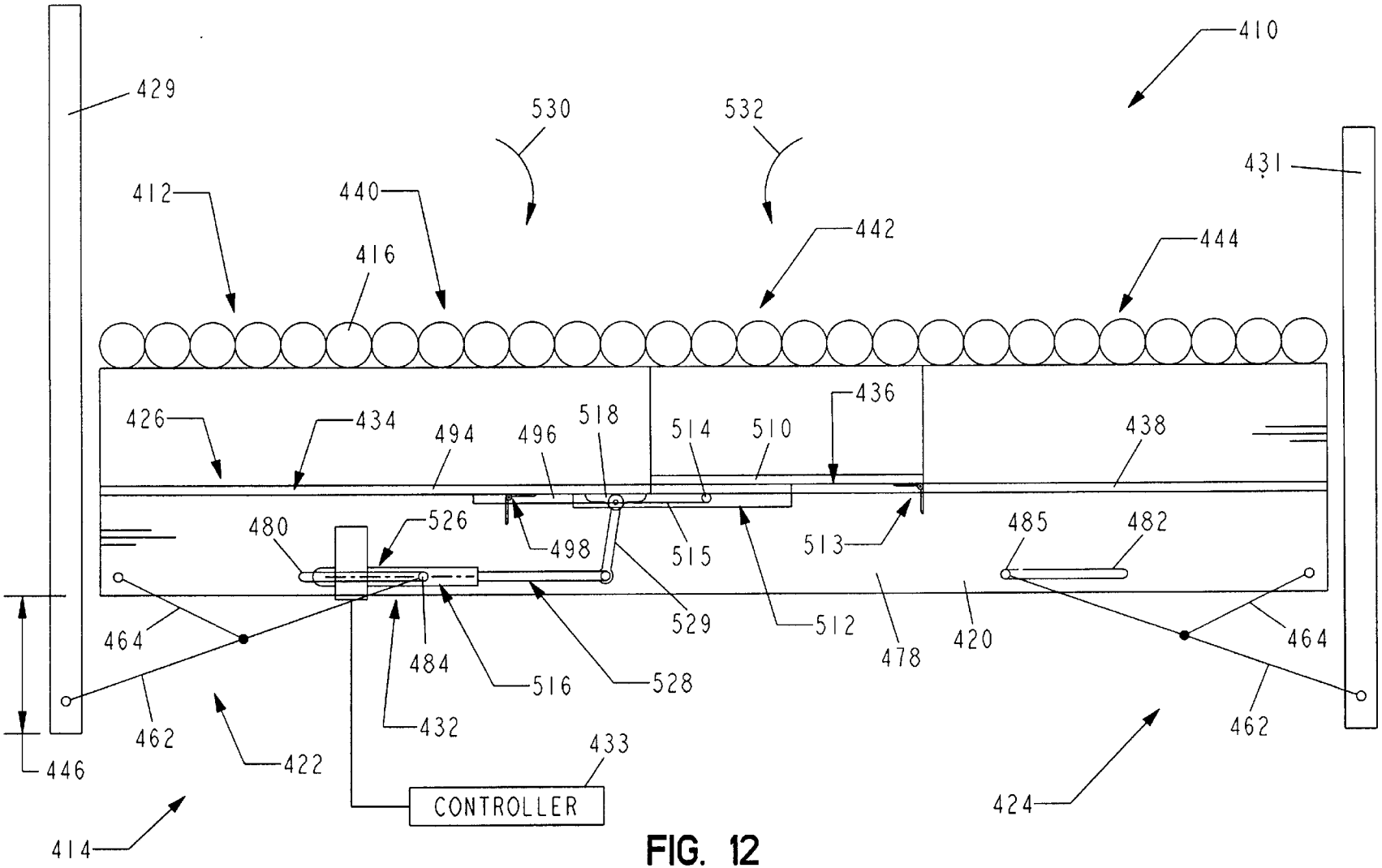
FIG. 12 is a side elevation view of another bed in accordance with the present disclosure showing the bed including a headboard, a footboard, a platform coupled to the headboard and footboard by a pair of lift arms, and a mattress positioned over the platform.
Figure 13:
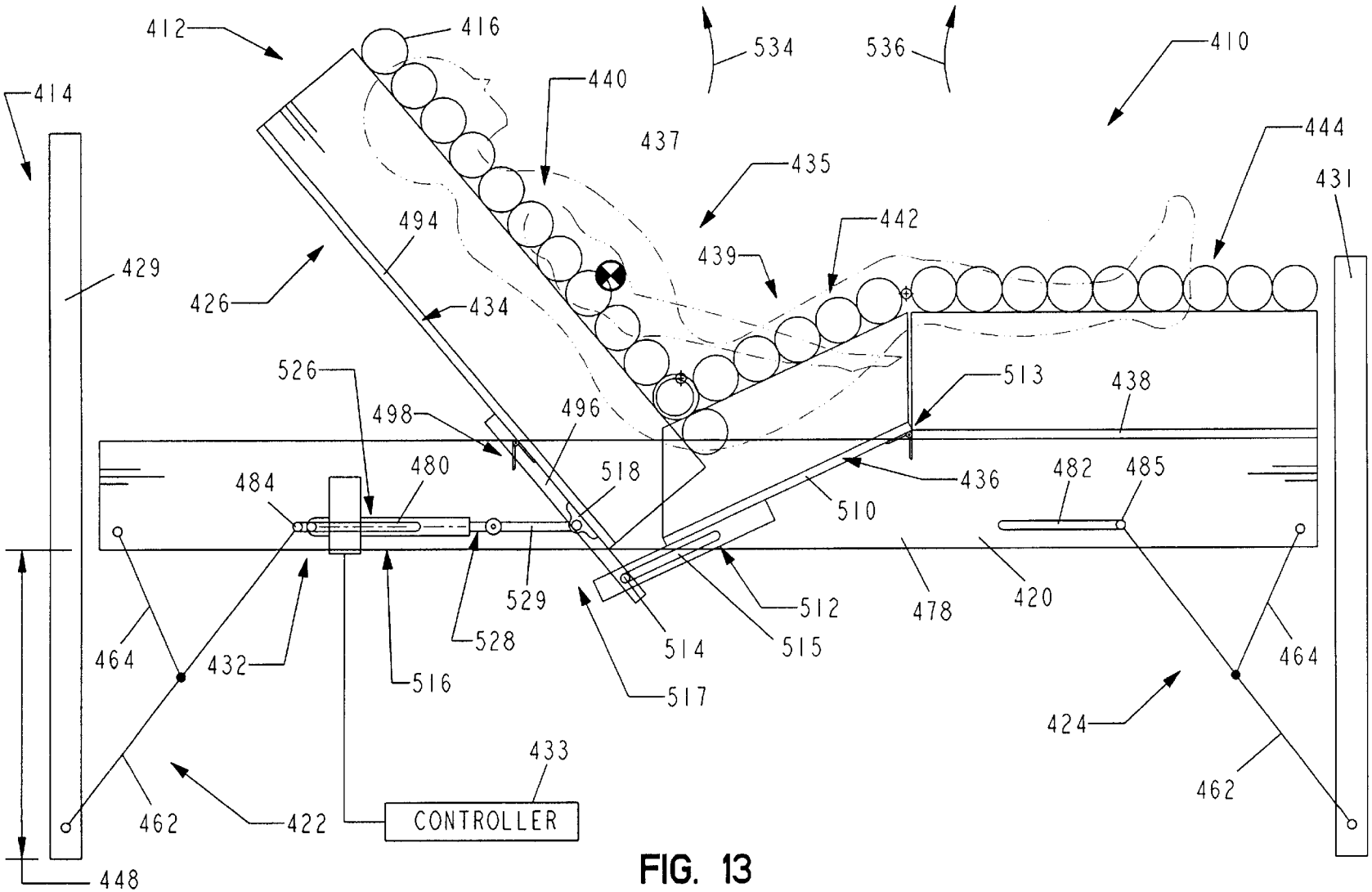
FIG. 13 is a view similar to FIG. 12 showing the platform in a raised position and the bed further including an articulated deck in a seated position supporting the mattress.

A bed 410 in accordance with the another embodiment of the present disclosure is illustrated in FIGS. 12 and 13. Bed 410 includes a mattress 412 and a bedframe 414 supporting mattress 412 over the floor. Mattress 412 provides a rest or support surface 416 configured to receive a person (not shown). Bedframe 414 includes a headboard 429, a footboard 431, an intermediate frame 420, a pair of lift arms 422, 424 coupling intermediate frame 420 to headboard 429 and footboard 431, and an articulated deck 426 positioned between mattress 412 and intermediate frame 420. Additional description of mattresses suitable for use with bed 410 is provided in U.S. Provisional Patent Application Serial No. 60/184,992, titled MATTRESS HAVING AIR FLUIDIZED BLADDERS, filed Feb. 25, 2000; U.S. Provisional Patent Application titled AIR FLUIDIZED BLADDERS FOR A BED, filed Oct. 17, 2000; and U.S. Utility Patent Application titled AIR FLUIDIZED BLADDER FOR A BED, filed Feb. 23, 2001, the disclosures of which are expressly incorporated by reference herein.

Bed 410 can be manipulated by a caregiver or by a person, as shown in FIG. 13, by using a hydraulic system 432 so that mattress 412, intermediate frame 420, and articulated deck 426 assume a variety of positions. Articulated deck 426 includes a head section 434, a seat section 436, and a foot section 438. Mattress 412 rests on deck 426 and includes a head portion 440, a seat portion 442, and a foot portion 444, each of which generally corresponds to the like-named portions of deck 426, and each of which is generally associated with the head, seat, and feet of the person on rest surface 416.

As shown in FIG. 12, bed 410 can assume a bed position having deck 426 configured so that rest surface 416 is planar and horizontal. In a low position, intermediate frame 420 is a predetermined first distance 446 above the floor. Bed 410 can also be manipulated to assume a high position shown in FIG. 13 with intermediate frame 420 a predetermined second distance 448 above the floor, the second distance 448 being greater than first distance 446.

Bed 410 can be moved to a Trendelenburg position (not shown) having deck 426 in a planar configuration and tilted so a head end of rest surface 416 is positioned closer to the floor than a foot end of rest surface 416. Bed 410 can also achieve a Reverse Trendelenburg position (not shown) having deck 426 in a planar configuration and tilted so that the foot end of rest surface 416 is positioned closer to the floor than the head end of rest surface 416.

Bed 410 is convertible to a seated position shown in FIG. 13. In the seated position, the head end of head section 434 of deck 426 is pivoted upwardly away from intermediate frame 420 to a back-support position providing a pivotable backrest for a person positioned on rest surface 416. Seat section 436 of deck 426 is pivoted downwardly toward intermediate frame 420 to a seat-support position providing a pivotably seat for a person positioned on rest surface 416. Foot section 438 of deck 426 extends generally horizontally from seat section 436. Bed 410 is also capable of assuming positions in which head and seat sections 434, 436 of deck 426 are in positions intermediate to those shown in FIGS. 12 and 13.

Lift arms 422, 424 are coupled to respective headboard 429 and footboard 431 and intermediate frame 420. Lift arms 422, 424 are configured to raise and lower intermediate frame 420 between the low and high positions relative to the floor. The power and control for such movement is provided by hydraulic system 432.

Each lift arm 422, 424 includes a first link 462 and a second link 464. Each first link 462 is slidably coupled to intermediate frame 420 and pivotably coupled to respective headboard 429 and footboard 431. Each second link 464 is pivotably coupled to intermediate frame 420 and pivotably coupled to respective first links 462.

Hydraulic system 432 includes a head end actuator (not shown) coupled to two of headboard 429, first link 462 of first lift arm 422, second link 464 of first lift arm 422, or intermediate frame 420. Hydraulic system 432 also includes a foot end actuator (not shown) coupled to two of footboard 431, first link 462 of second lift arm 424, second link 464 of second lift arm 424, or intermediate frame 420. For example, according to one embodiment of the present disclosure, the actuators are coupled to either of the respective headboard and footboard and the junction of the first and second links of the lift arms. According to another alternative embodiment of the present disclosure, the actuators are coupled to the respective headboard and footboard and the first link of the lift arms. According to yet another embodiment, the actuators are coupled between the first and second links of the lift arms.

Hydraulic system 432 further includes a controller 433 configured to regulate the operation of the head and foot end actuators. According to the preferred embodiment of the present disclosure, controller 433 includes a plurality of buttons or other command-receiving devices (not shown) for receiving commands from a patient positioned on bed 410 or a caregiver. Controller 433 is configured to automatically control the extension and retraction of the head and foot end actuators when a patient or caregiver selects a given position for intermediate frame 20 as is discussed in greater detail below.

The head end actuator is configured to provided the power to raise and lower the head end of intermediate frame 420 by changing the relative positions of headboard 429, first link 462 of first lift arm 422, second link 464 of first lift arm 422, and intermediate frame 420. Similarly, the foot end actuator is configured to provide the power to raise and lower the foot end of intermediate frame 20 by changing the relative positions of footboard 431, first link 462 of second lift arm 424, second link 464 of second lift arm 424, and intermediate frame 420.

Preferably the actuators are hydraulic cylinders. It will be appreciated, however, that in accordance with the present disclosure, various mechanical and electro-mechanical actuators and drivers may be used to raise and lower intermediate frame 420.

Intermediate frame 420 includes a platform member 478 and pair of slots 480, 482 formed therein as shown in FIG. 12. Slot 480 receives pin or roller 484 coupled to first link 462 of first lift arm 422. Similarly, slot 482 receives pin or roller 485 coupled to first link 462 of second lift arm 424. According to alternative embodiments, other configurations known to those of ordinary skill in the art are provided to slidably and/or pivotably couple the lift arms to the platform member.

The caregiver can adjust the height of rest surface 416 by activating the head and foot actuators to move lift arms 422, 424. When bed 410 is in the raised position, lift arms 422, 424 are in the raised position shown in FIG. 13 having the actuators in a first position. To lower intermediate frame 420, the head and foot actuators are moved to a second position to permit intermediate frame 420 to lower. As intermediate frame 420 is moved back to the raised position, pins 484, 485 of first and second lift arms 422, 424 ride in respective slots 480, 482 toward respective headboard 429 and footboard 431. The actuators can be moved between the first and second positions when bed 410 is in either bed or seated position. According to alternative embodiments of the present disclosure, other configurations of lift mechanisms and base frames are used to raise and lower the intermediate frame as disclosed herein or as known to those of ordinary skill in the art.

As previously mentioned, mattress 412 rests on head section 434, seat section 436, and foot section 438 of articulated deck 426 as shown in FIG. 13. Head and seat sections 434, 436 of articulated deck 426 are movable to change the position of a person 435 supported on rest surface 416 of mattress 412. Head section 434 and seat section 436 may be rotated to change the angle of inclination of torso 437 and thighs 439 of the person 435 with respect to intermediate frame 420. Head and seat sections 434, 436 cooperate to provide a "reduced-shear pivot" between head and seat sections 434, 436 to be described hereinafter. Foot section 438 remains horizontal, so that head and seat portions 440, 442 of mattress 412 move relative to foot portion 444 of mattress 412 and relative to each other.

Head section 434 includes a support member or deck panel 494 and a pair of bars 496 (only one bar is shown) rigidly coupled to deck panel 494. Panel 494, and therefore bars 496, is pivotably coupled to intermediate frame 420 by a hinge 498. Seat section 436 includes a support member or deck panel 510 and a pair of bars 512 (only one bar is shown) rigidly coupled to deck panel 494. Deck panel 510 is pivotably coupled to foot section 438 by a hinge 513. Bars 512 are formed to includes slots 515.

Bars 496, 512 extend beyond respective deck panels 494, 510 and cooperate to define a coupler 517 that couples deck panels 494, 510 together as shown in FIG. 13. Pins or rollers 514 are provided on the distal ends of bars 496 and positioned to ride in slots 515 of bars 512 so that head and seat sections 434, 436 of deck 426 are pivotably and slidably coupled together.

Hydraulic system 432 includes a deck section actuator 516 coupled to intermediate frame 420 and head section 434 as shown in FIGS. 12 and 13. Deck section actuator 516 is configured to provide power to move head and seat sections 434, 436 between the bed and seated positions. Controller 433 is configured to control extension and retraction of deck section actuator 516. Preferably, deck section actuator 516 is hydraulic. It will be appreciated, however, that in accordance with the present disclosure, various mechanical and electromechanical actuators and drivers may be used to move head and seat sections 434, 436.

As shown in FIG. 12, head section 434 further includes a flange 518 rigidly coupled to deck panel 494. Deck section actuator 516 includes a cylinder body 526 rigidly coupled to intermediate frame 420 and a piston rod 528. Another rod 529 is provided that is pivotably coupled to flange 518 of head section 434 and piston rod 528.

To move rest surface 416 from the bed position, as shown in FIG. 12, to the seated position, as shown in FIG. 12, actuator 516 is retracted. During this retraction, piston rod 528 pulls a foot end of head section 434 away from a head end of seat section 436. Because head section 434 is restrained by hinges 498 and seat section 436 is likewise restrained by hinges 513, head section 434 pivots in a clockwise direction 530 and seat section 436 pivots in a counterclockwise direction 532.

Because pins 514 are constrained to move in slots 515 of bars 512, the angular position of head section 434 relative to seat section 436 is likewise constrained to follow a predetermined relationship with the retraction of piston rod 528. Thus, when deck section actuator 516 is in the fully retracted position, head section 434 is at a predetermined angle of 5020 relative to the floor and seat section 436 is at a predetermined angle of 25° relative to the floor. According to alternative embodiments of the present disclosure, the head and seat sections are tilted at other angles.

To move deck 426 back to the bed position, deck section actuator 516 is moved to the extended position. This extension pushes the foot end of head section 436 and the head end of seat section 436 together and narrows the gap therebetween. As head and seat sections 434, 436 move closer together, head section 434 rotates in a counterclockwise direction 534 and seat section 436 rotates in a clockwise direction 536 until both head and seat sections 434, 436 are substantially parallel to the floor. Actuator 516 may also be activated to move head and seat sections 434, 436 to positions intermediate those shown in FIGS. 12 and 13.

As shown in FIG. 13, a center-of-gravity 441 of a patient's torso 437 is centered more over hinge 498 than the foot end of head section 434. Because of this centering, actuator 516 can be of a smaller rating or power than if the hinge between the head section and the intermediate frame was at the foot end of the head section.

Figure 14:
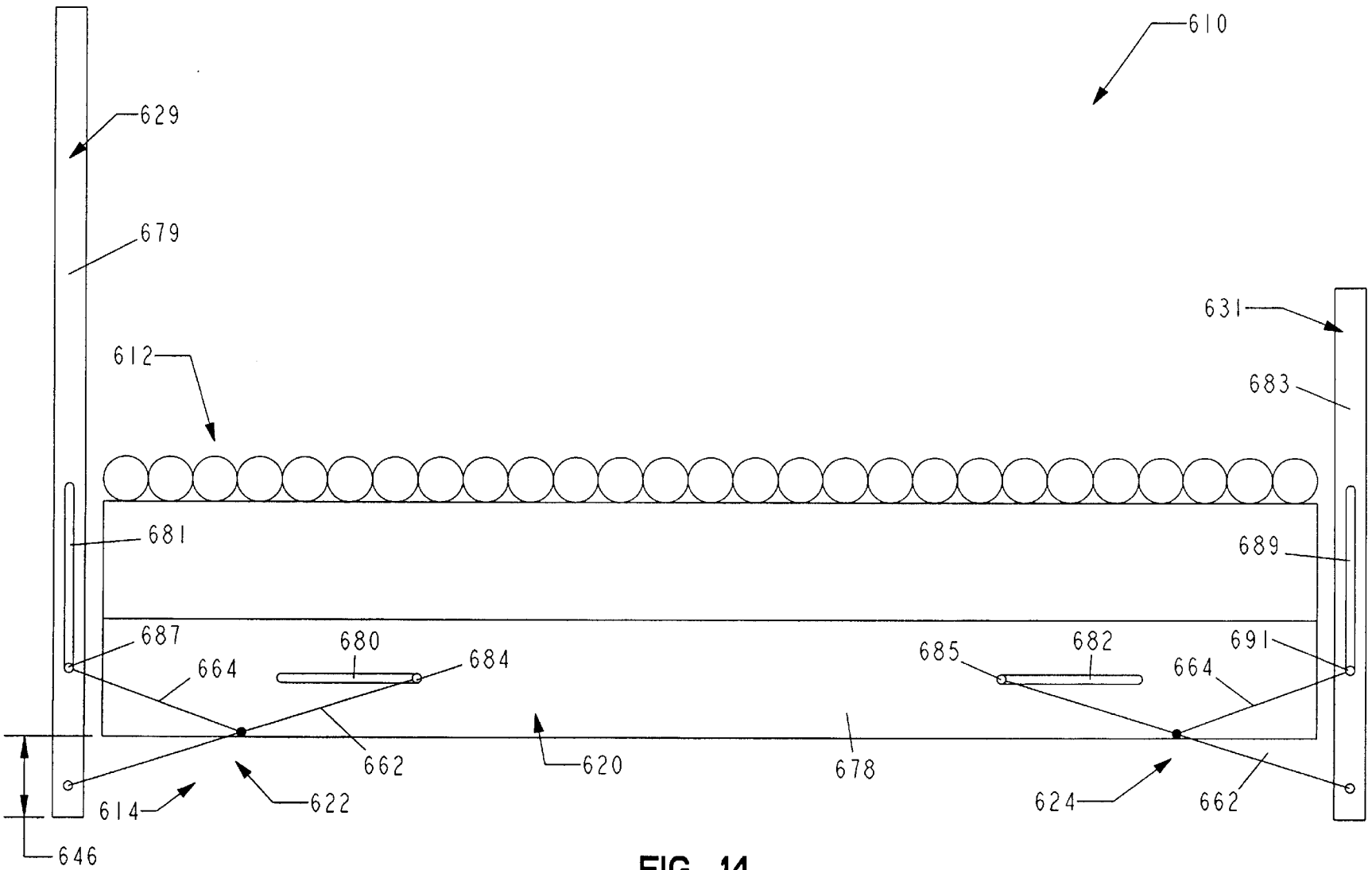
FIG. 14 is a side elevation view of another bed in accordance with the present disclosure showing the bed including a headboard, a footboard, a platform coupled to the headboard and footboard in a lowered position by a pair of lift arms, and a mattress positioned over the platform.
Figure 15:
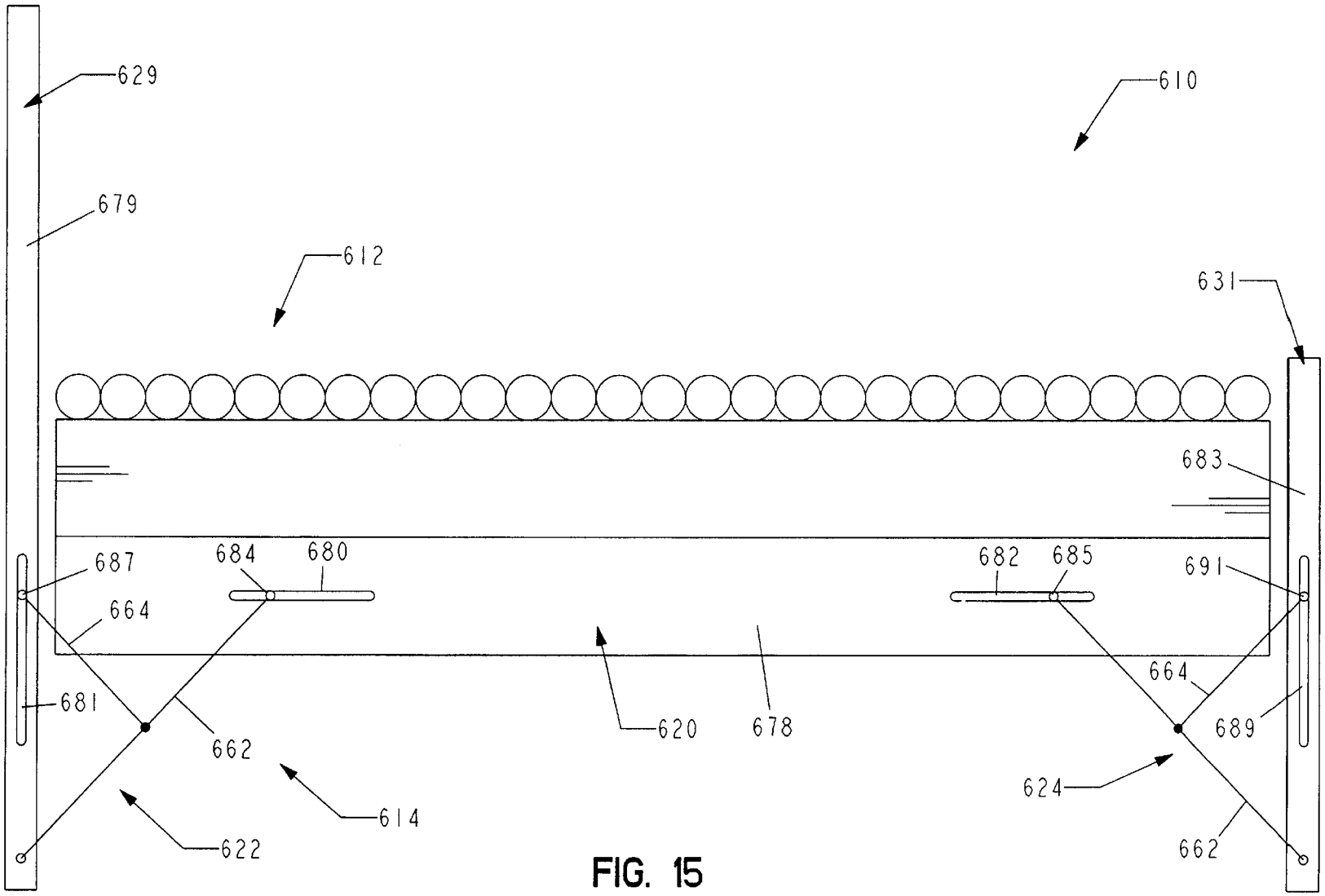
FIG. 15 is a view similar to FIG. 14 showing the platform supported by the lift arms in an intermediate position.
Figure 16:
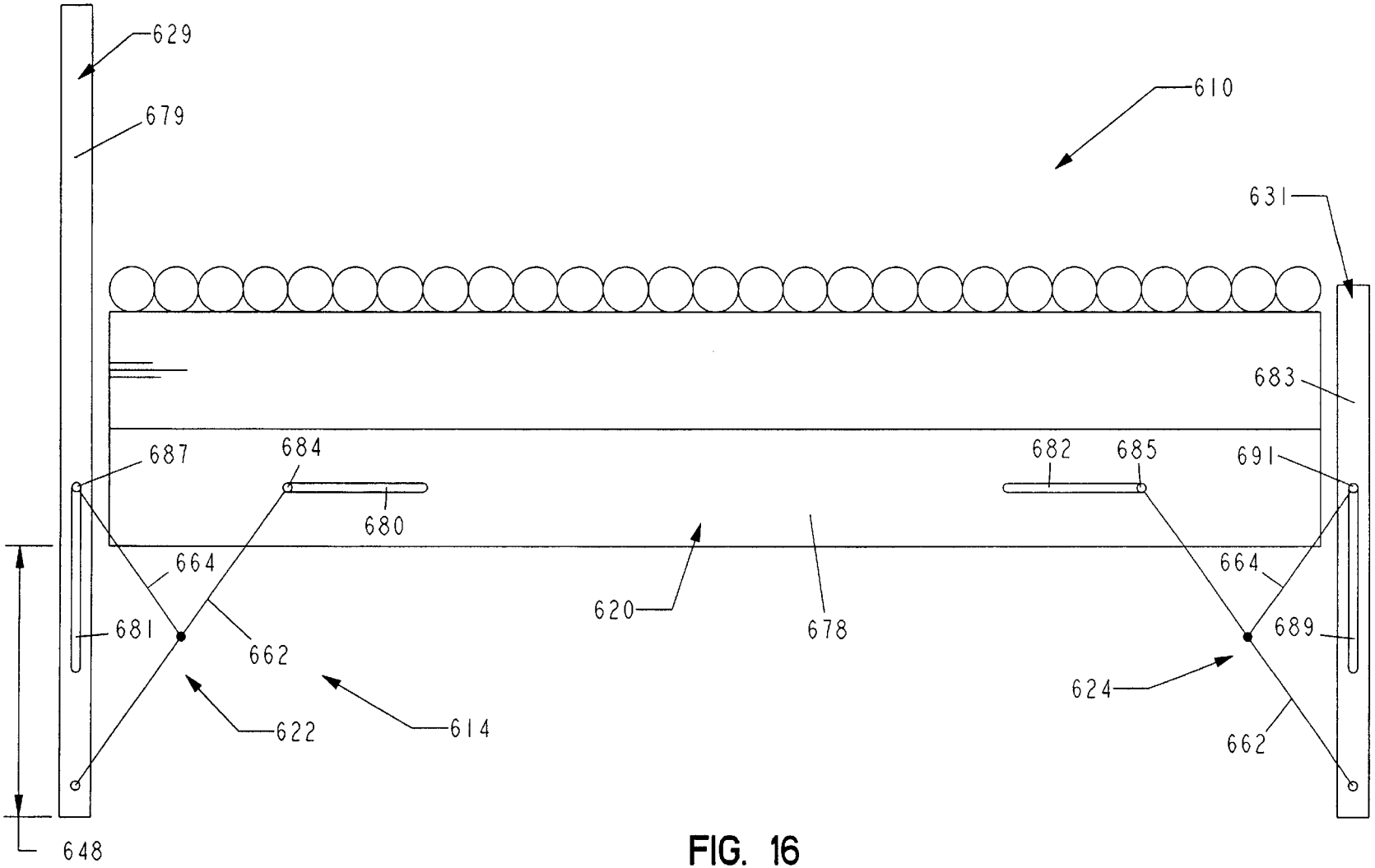
FIG. 16 is a view similar to FIG. 14 showing the platform supported by the lift arms in a raised position.

A bed 610 in accordance with the another embodiment of the present disclosure is illustrated in FIGS. 14–16. Bed 610 includes a mattress 612 and a bedframe 614 supporting mattress 612 over the floor of a care facility. Mattress 612 provides a rest or support surface 616 configured to receive a person (not shown). Bedframe 614 includes a headboard 629, a footboard 631, an intermediate frame 620, and a pair of lift arms 622, 624 coupling intermediate frame 620 to headboard 629 and footboard 631.

Bed 610 can be manipulated by a caregiver or by a person using a hydraulic system (not shown) so that mattress 612, can be raised and lowered. In a low position, intermediate frame 620 is a predetermined first distance 646 above the floor. Bed 610 can also be manipulated to assume a high position shown in FIG. 16 with intermediate frame 620 a predetermined second distance 648 above the floor, the second distance 648 being greater than first distance 646.

Bed 610 can be moved to a Trendelenburg position (not shown) having mattress 612 in a planar configuration and tilted so a head end of rest surface 616 is positioned closer to the floor than a foot end of rest surface 616. Bed 610 can also achieve a Reverse Trendelenburg position (not shown) having mattress 612 in a planar configuration and tilted so that the foot end of rest surface 616 is positioned closer to the floor than the head end of rest surface 616.

Lift arms 622, 624 are coupled to respective headboard 629 and footboard 631 and intermediate frame 620. Lift arms 622, 624 are configured to raise and lower intermediate frame 620 between the low and high positions relative to the floor. The power and control for such movement is provided by a hydraulic system (not shown).

Each lift arm 622, 624 includes a first link 662 and a second link 664. Each first link 662 is slidably coupled to intermediate frame 620 and pivotably coupled to respective headboard 629 and footboard 631. Each second link 664 is pivotably coupled to respective first links 662 and slidably and pivotably coupled to respective headboard 629 and footboard 631.

The hydraulic system includes a head end actuator (not shown) coupled to two of headboard 629, first link 662 of first lift arm 622, second link 664 of first lift arm 622, or intermediate frame 620. The hydraulic system 632 also includes a foot end actuator (not shown) coupled to two of footboard 631, first link 662 of second lift arm 624, second link 664 of second lift arm 624, or intermediate frame 620. For example, according to one embodiment of the present disclosure, the actuators are coupled to either of the respective headboard and footboard and the junction of the first and second links of the lift arms. According to another alternative embodiment of the present disclosure, the actuators are coupled to the respective headboard and footboard and the first link of the lift arms. According to yet another embodiment, the actuators are coupled between the first and second links of the lift arms.

The head end actuator is configured to provide the power to raise and lower the head end of intermediate frame 620 by changing the relative positions of headboard 629, first link 662 of first lift arm 622, second link 664 of first lift arm 622, and intermediate frame 620. Similarly, the foot end actuator is configured to provide the power to raise and lower the foot end of intermediate frame 620 by changing the relative positions of footboard 631, first link 662 of second lift arm 624, second link 664 of second lift arm 624, and intermediate frame 620. Preferably the actuators are hydraulic cylinders. It will be appreciated, however, that in accordance with the present disclosure, various mechanical and electromechanical actuators and drivers may be used to raise and lower intermediate frame 620.

The hydraulic system further includes a controller (not shown) configured to regulate the operation of the head and foot end actuators. According to the preferred embodiment of the present disclosure, the controller includes a plurality of buttons or other command-receiving devices (not shown) for receiving commands from a patient positioned on bed 610 or a caregiver. The controller is configured to automatically control the extension and retraction of the head and foot end actuators when a patient or caregiver selects a given position for intermediate frame 620 as is discussed in greater detail below.

Intermediate frame 620 includes a platform member 678 and pair of slots 680, 682 formed therein as shown in FIG. 14. Slot 680 receive a pin or roller 684 coupled to first link 662 of first lift arm 622. Similarly, slot 682 receives a pin or roller 685 coupled to first link 662 of second lift arm 624. Headboard 629 includes a board member 679 and a slot 681. Slot 681 receives a pin or roller 687 coupled to second link 664 of first lift arm 622. Similarly, footboard 631 includes a board member 683 and a slot 689. Slot 689 receives a pin or roller 691 coupled to second link 664 of second lift arm 624.

The caregiver can adjust the height of rest surface 616 by activating the head and foot actuators to move lift arms 622, 624. When bed 610 is in the raised position, lift arms 622, 624 are in the raised position shown in FIG. 16 having the actuators in a first position. To lower intermediate frame 620, the head and foot actuators are moved to a second position to permit intermediate frame 620 to lower. As intermediate frame 620 is moved to the lowered position, pins 684, 685 of first and second lift arms 622, 624 ride in respective slots 680, 682 away from respective headboard 629 and footboard 631 and pins 687, 691 move down in respective slots 681, 689. As shown in FIG. 15, intermediate frame 620 may also be moved to positions intermediate the fully raised and lowered positions.

Figure 17:
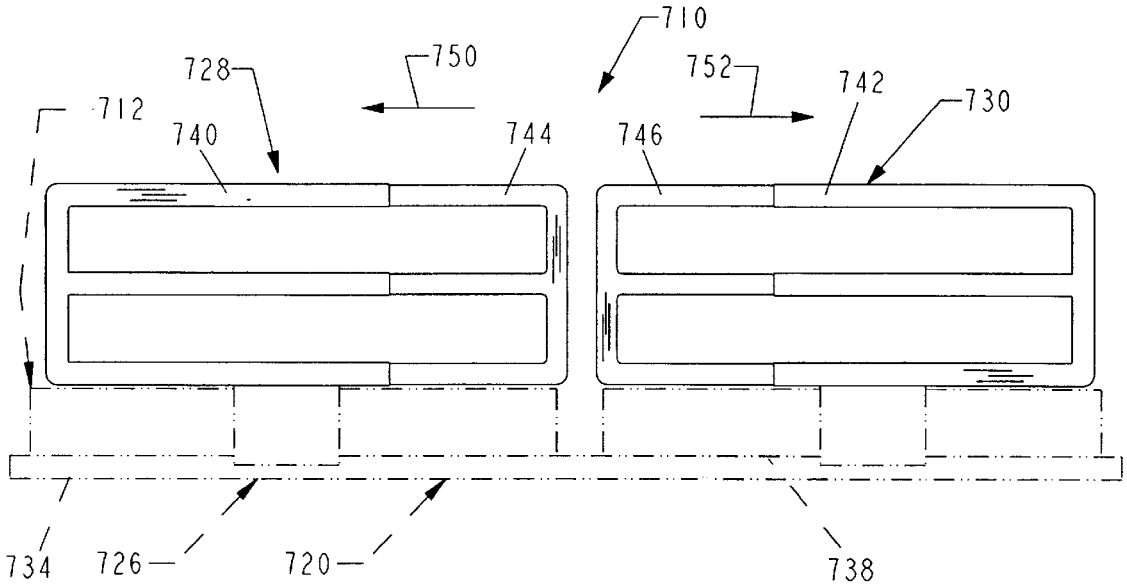
FIG. 17 is a side elevation view of another embodiment bed showing the bed including an intermediate frame (in phantom), an articulated deck (in phantom), a telescoping head end siderail coupled to a head section of the articulated deck, and a telescoping foot end siderail coupled to a foot section of the articulated deck.
Figure 18:
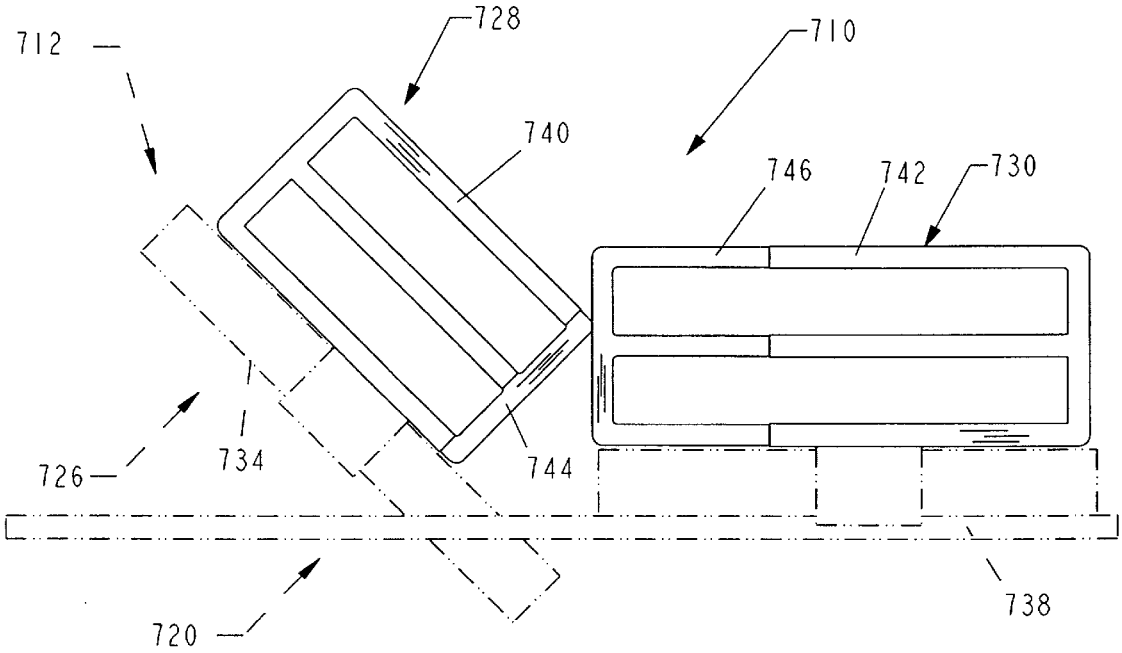
FIG. 18 is a view similar to FIG. 17 showing the head section of the articulated deck tilted relative to the intermediate frame and the overall length of the head end siderail shortened due to contact with the foot end siderail.

An alternative embodiment bed 710 is illustrated in FIG. 17. Bed 710 includes a bedframe having an intermediate frame 720 (shown in phantom) and an articulated deck 726 (shown in phantom) having a foot section 738 and head section 734 that moves relative to foot section 738 as shown in FIG. 18. Bed 710 further includes a telescoping head end siderail 728 and a telescoping foot end siderail 730. Head and foot end siderails 728, 730 each include a fixed rail member 740, 742 and a sliding rail member 744, 746 telescopically received by respective fixed members 740, 742.

During movement of head section 734 relative to foot section 738, sliding member 744 of head end siderail 728 contacts foot end siderail 730. This contact pushes sliding member 744 in direction 750 further into fixed member 740 as shown in FIG. 18. Sliding member 744 is biased outwardly so that when head section 734 is moved back to the down or lowered position, sliding member 744 automatically returns to the extended position shown in FIG. 17. Thus, sliding member 744 is a compliant member that ceases movement to avoid undesirable contact pressure between sliding member 744 and foot end siderail 730.

When head section 734 is in the flat bed position, as shown in FIG. 17, sliding members 744, 746 can also be moved in respective directions 750, 752 to provide access to a patient positioned on mattress 712. According to alternative embodiments of the present disclosure, latches, locks, or other holding devices are provided that maintain the sliding members in the retracted position to facilitate access to the patient positioned on the mattress.

Figure 19:
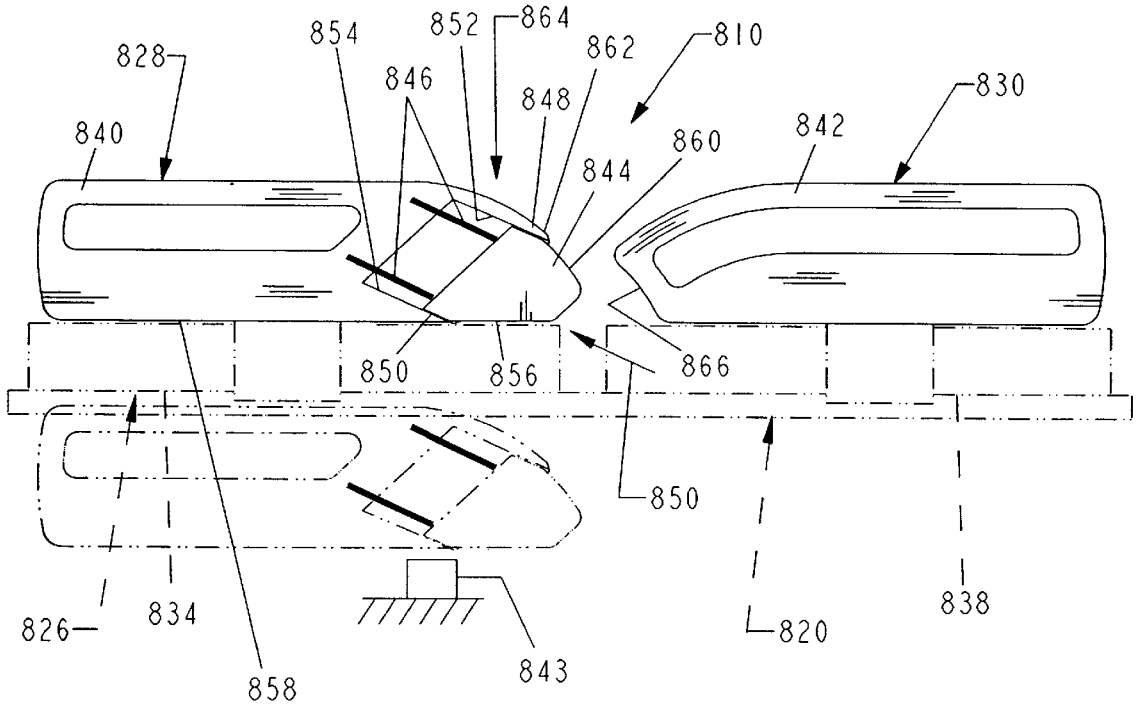
FIG. 19 is a side elevation view of another bed showing the bed including an intermediate frame (in phantom), an articulated deck (in phantom), a head end siderail coupled to a head section of the articulated deck, and a foot end siderail coupled to a foot section of the articulated deck, the head end siderail including a first rail member and a second rail member or shuttle member slidably received in the first rail member.
Figure 20:
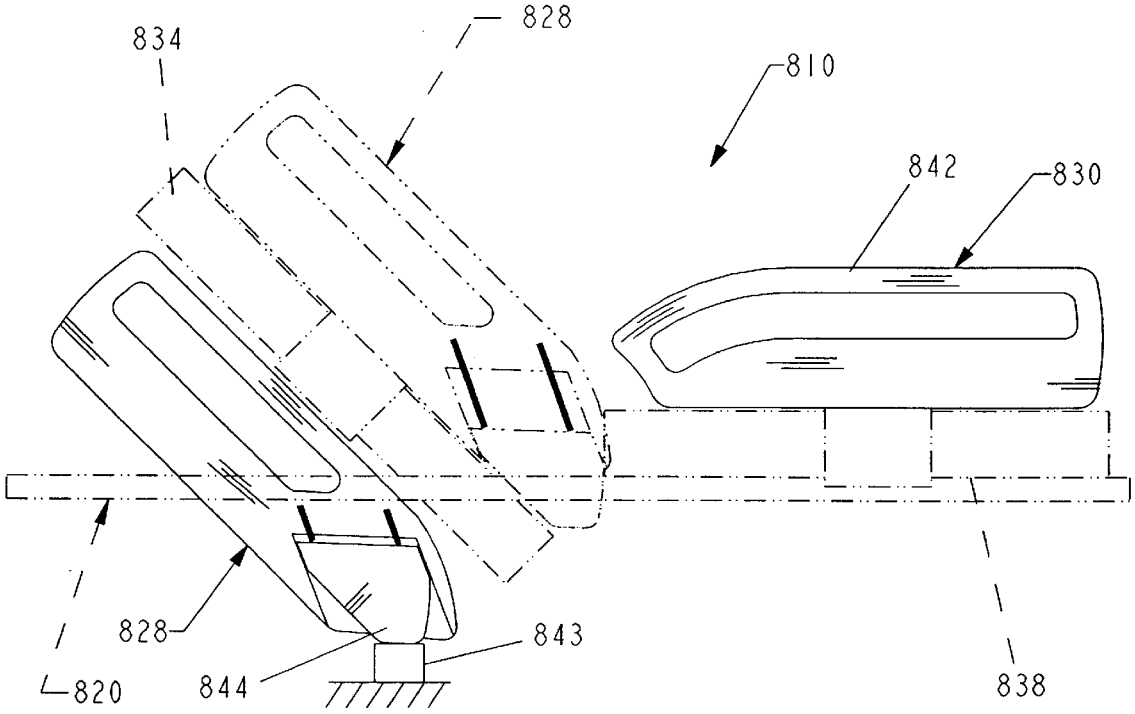
FIG. 20 is a view similar to FIG. 19 showing the head section of the articulated deck tilted relative to the intermediate frame and the shuttle member pushed further into the first rail member against the bias of a pair of compression springs.

Another alternative embodiment bed 810 is illustrated in FIG. 19. Bed 810 includes a bedframe having an intermediate frame 820 (shown in phantom) and an articulated deck 826 (shown in phantom) having a foot section 838 and head section 834 that moves relative to foot section 838 as shown in FIG. 20. Bed 810 further includes a head end siderail 828 and a foot end siderail 830. Head and foot end siderails 828, 830 each include a first rail member 840, 842. Head end siderail 828 further includes a second rail or shuttle member 844 slidably received within a pocket defined in first rail member 840.

As shown in FIGS. 19 and 20, head end siderail 828 is configured to move between a raised position blocking egress of a person from bed 810 and a lowered position permitting egress. If head end siderail 828 is in the lowered position during movement of head section 834 relative to foot section 838, shuttle member 844 of head end siderail 828 could potentially contact an object 843 positioned on the floor. This contact stops movement of shuttle member 844 to avoid unacceptable pressure on object 843. Thus, shuttle member 844 is a compliant member 844 that moves in direction 850 further into rail member 840 as shown in FIG. 20 to limit contact pressure on object 843.

Shuttle member 844 includes a pair of spaced-apart parallel side walls 848, 850 that slide along complementary side walls 852, 854 of rail member 840. Shuttle member 844 further includes a bottom wall 852 that is substantially co-linear with a bottom wall 854 of rail member 840 and another side wall 856 that cooperates with a sidewall 858 of rail member 840 to define a substantially curved surface 860 that complements a curved surface 862 of rail member 842.

Shuttle member 844 is biased outwardly by a pair of springs 846 so that when head section 834 is moved back to the down or lowered position or head end siderail 828 is moved to the raised position, shuttle member 844 automatically returns to the extended position shown in FIG. 19. Preferably, head end siderail 828 is also provided with a pair of panels (not shown) to cover springs 846 and the portion of shuttle member 844 positioned in rail member 840.

A stop (not shown) is provided to prevent shuttle member 844 from being pushed out of rail member 840 by springs 846. According to alternative embodiments of the present disclosure, the stop includes a pin coupled to the rail member and the shuttle member includes a slot. The pin rides in the slot, but engages a closed end of the slot to prevent the shuttle member from being pushed out of the rail member by the springs. According to alternative embodiments of the present disclosure, other arrangements of stops known to those of ordinary skill in the art are provided.

Figure 21:
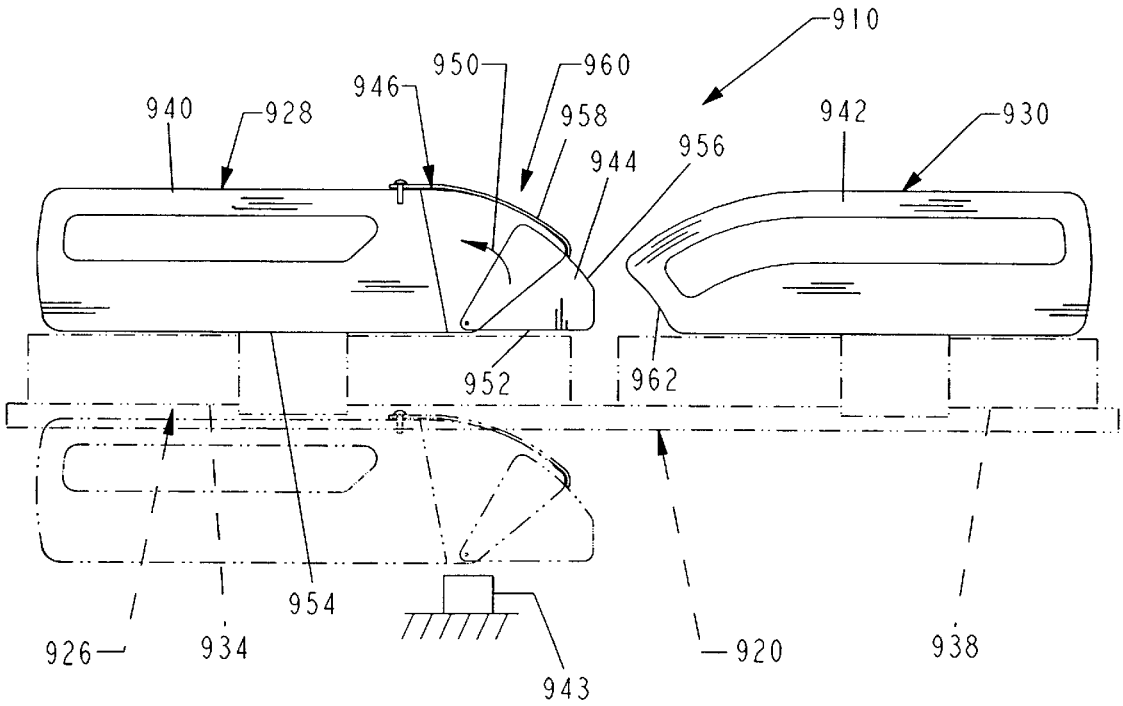
FIG. 21 is a side elevation view of another bed showing the bed including an intermediate frame (in phantom), an articulated deck (in phantom), a head end siderail coupled to a head section of the articulated deck, and a foot end siderail coupled to a foot section of the articulated deck, the head end siderail including a first rail member and a second rail member or pivot member pivotably received in the first rail member.
Figure 22:
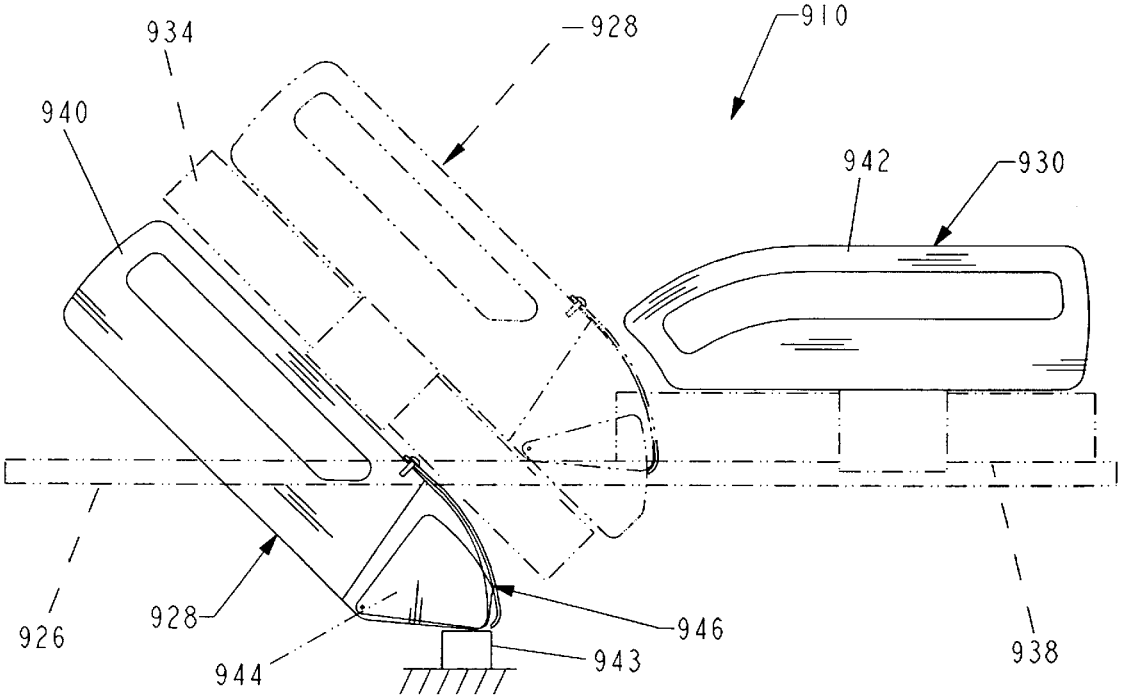
FIG. 22 is a view similar to FIG. 21 showing the head section of the articulated deck tilted relative to the intermediate frame and the pivot member pushed further into the first rail member.

Yet another alternative embodiment bed 910 is illustrated in FIG. 21. Bed 910 includes a bedframe having an intermediate frame 920 (shown in phantom) and an articulated deck 926 (shown in phantom) having a foot section 938 and head section 934 that moves relative to foot section 938 as shown in FIG. 22. Bed 910 further includes a head end siderail 928 and a foot end siderail 930. Head and foot end siderails 928, 930 each include a first rail member 940, 942. Head end siderail 928 further includes a second rail member of pivot member 944 pivotably received by a cover 946 of first rail member 942.

As shown in FIGS. 21 and 22, head end siderail 928 is configured to move between a raised position blocking egress of a person from bed 910 and a lowered position permitting egress. If head end siderail 928 is in the lowered position during movement of head section 934 relative to foot section 938, pivot member 944 of head end siderail 928 could potentially contact an object 943 positioned on the floor. This contact stops movement of pivot member 944 to avoid unacceptable pressure on object 943. Thus, pivot member 944 is a compliant member that moves in direction 950 further into cover 946 as shown in FIG. 22 to avoid unacceptable pressure on object 943.

Shuttle member 844 includes a bottom wall 952 that is substantially co-linear with a bottom wall 954 of rail member 940. Shuttle member 844 further includes a side wall 956 that cooperates with a sidewall 958 of cover 946 to define a substantially curved surface 960 that complements a curved surface 962 of rail member 942.

Pivot member 944 is biased in a clockwise direction by gravity so that when head section 934 is moved back to the down or lowered position or head end siderail 928 is moved to the raised position, pivot member 944 automatically returns to the extended position shown in FIG. 21. According to an alternative embodiment of the present disclosure, the pivot member is biased by a torsion or other spring.

A stop (not shown) is provided to prevent pivot member 944 from being pushed out of rail member 940 by gravity. According to alternative embodiments of the present disclosure, the stop includes a pin coupled to the rail member and the pivot member includes a slot. The pin rides in the slot, but engages a closed end of the slot to prevent the pivot member from being pulled out of the rail member by gravity. According to alternative embodiments of the present disclosure, other arrangements of stops known to those of ordinary skill in the art are provided.

Although the features of the present disclosure are described with respect to beds, they can also be used in an examination table, chair bed, stretcher, gurney, wheel chair, or any other device for supporting a person. According to alternative embodiments of the present disclosure, the various intermediate frame lifting mechanisms disclosed herein and known to those of ordinary skill in the art may be interchanged with the various articulated decks disclosed herein and those known to those of ordinary skill in the art.

Although the invention has been described in detail with reference to preferred embodiments, variations and modifications exist within the scope and spirit of the disclosure.

What is claimed is:

1. A patient support comprising a frame, an intermediate frame moveable relative to a floor, a deck positioned on the intermediate frame, the deck including first and second deck sections pivotably coupled to the intermediate frame, the intermediate frame including a recessed portion configured to receive the first and second deck sections during movement of the deck sections relative to the intermediate frame, the second deck section including a portion fixed at a position on the intermediate frame, the recessed portion including an outer width, the first deck section being positioned over the recessed portion of the intermediate frame and including an outer width greater than the outer width of the recessed portion, and a mattress positioned on the deck.

2. The patient support of claim 1, wherein the mattress is received in the recessed portion of the intermediate frame.

3. The patient support of claim 1, wherein the mattress has a width greater than the outer width of the recessed portion of the intermediate frame.

4. The patient support of claim 1, wherein the second deck section includes a width that is greater than the outer width of the recessed portion.

5. The patient support of claim 4, wherein the second deck section is coupled to the first deck section.

6. The patient support of claim 1, wherein the deck overhangs the frame.

7. A patient support comprising a frame including a recessed portion defining a recess and a board support portion coupled to the recessed portion, an end board coupled to the board support portion of the frame in a substantially vertical position, a deck supported by and configured to move relative to the frame, and a mattress positioned on the deck, the mattress including a head section, a foot section, and a seat section, the seat section of the mattress being positioned in the recess during movement of the deck relative to the frame.

8. The patient support of claim 7, wherein the deck is positioned adjacent to the recessed portion of the frame.

9. The patient support of claim 7, wherein a portion of the mattress is positioned below the board support portion of the frame when the seat section of the mattress is positioned in the recess.

10. A patient support comprising a frame, a deck positioned on the frame, the deck including first and second deck sections pivotably coupled to the frame, the frame including a recessed portion configured to receive the first and second deck sections during movement of the deck sections relative to the frame, the recessed portion including an outer width, the first deck section being positioned over the recessed portion of the frame and including an outer width greater than the outer width of the recessed portion, and a mattress positioned on the deck, and wherein the frame includes a second recessed portion spaced apart from the first mentioned recessed portion by a distance, the second recessed portion defining a recess, and the portion of the mattress being positioned in the recess defined by the second recessed portion.

11. The patient support of claim 10, wherein the deck has a width greater than the distance between the recessed portions of the frame.

12. A patient support comprising a frame including an intermediate frame and a base frame supporting the intermediate frame, a footboard coupled to the intermediate frame, a deck positioned on the intermediate frame, the intermediate frame being movable relative to the base frame between a first position supporting the deck in a horizontal position and a second position supporting the deck in a non-horizontal position, the deck including a deck section configured to move between first and second positions relative to the frame, the deck section including a foot section fixed at a position adjacent to the footboard, the intermediate frame including a pair of spaced-apart frame members including recessed portions configured to receive the deck section when in the second position, the recessed portions being spaced apart by a first distance, the deck section being positioned above the recessed portion of the spaced-apart frame members and including an outer width greater than or equal to the first distance, and a mattress positioned on the deck.

13. The patient support of claim 12, wherein the deck section overhangs the recessed portions of the frame members.

14. The patient support of claim 12, wherein the base frame includes a pair of feet positioned on the ground to support the frame members and the recessed portions of the frame members are positioned between the feet.

15. The patient support of claim 12, wherein the mattress is positioned in the recessed portions of the frame members when the deck is in the second position.

16. A patient support comprising a frame including a concave portion defining a recess, a deck positioned on the frame, the deck including first and second deck sections configured to move relative to the frame between a first position and second position, the concave portion of the frame being configured to provide clearance for the first and second deck sections to move in the recess when moving between the first and second positions, a deck section actuator coupled between the deck sections to power movement of the deck sections relative to the frame, and a mattress positioned on the deck.

17. The patient support of claim 16, wherein the deck sections have a width greater than a width of the concave portion of the frame.

18. The patient support of claim 16, wherein the deck rests on the concave portion of the frame when in a seated position.

19. The patient support of claim 16, wherein the frame further includes a pair of substantially horizontally extending portions, the concave portion of the frame is positioned between the substantially horizontal portions.

20. The patient support of claim 19, wherein the concave portion is coupled to the substantially horizontal portions and extends downwardly from the horizontally extending portions.

21. The patient support of claim 19, wherein the deck contacts the substantially horizontally extending portions when in the first position.

22. The patient support of claim 21, wherein the deck contacts the concave portion when in the second position.

23. The patient support of claim 21, wherein the deck is spaced apart from the concave portion when in the first position.

24. A patient support comprising a frame, a deck positioned on the frame, the deck including first and second deck sections pivotably coupled to the frame, the frame including a recessed portion configured to receive the first and second deck sections during movement of the deck sections relative to the frame, the recessed portion including an outer width, the first deck section being positioned over the recessed portion of the frame and including an outer width greater than the outer width of the recessed portion, and a mattress positioned on the deck, and wherein the deck further includes a coupler configured to couple a first end of the first deck section to a second end of the second deck section, the coupler is configured to coordinate movement of the first and second deck sections during movement of the first and second deck sections relative to the frame between first and second positions, the first end of the first deck section is spaced apart from the second end of the second deck section by a first distance when in the first position, the first end of the first deck section is spaced apart from the second end of the second deck section by a second distance when in the second position, the second distance is greater than the first distance, the patient support further comprising an actuator coupled to the first deck section, the actuator being configured to move the first deck section between the first and second positions.

25. The patient support of plain 24, wherein the actuator is coupled to the second deck section.

26. The patient support of claim 24, wherein the coupler is configured to permit sliding of the first deck section relative to the second deck section during movement between the first and second positions.

27. The patient support of claim 26, wherein the coupler is configured to permit pivoting of the first deck section relative to the second deck section during movement between the first and second positions.

28. The patient support of claim 24, wherein the first and second deck sections are substantially coplanar when in the first position.

29. A patient support comprising a frame including a recessed portion defining a recess and a board support portion coupled to the recessed portion, an end board coupled to the board support portion of the frame in a substantially vertical position, a deck supported by and configured to move relative to the frame, a mattress positioned on the deck, a portion of the mattress being positioned in the recess during movement of the deck relative to the frame, and wherein the deck includes a first deck section, a second deck section, and a coupler configured to couple a first end of the first deck section to a second end of the second deck section, the coupler is configured to coordinate movement of the first and second deck sections during movement of the first and second deck sections relative to the frame between first and second positions, the first end of the first deck section is spaced apart from the second end of the second deck section by a first distance when in the first position, the first end of the first deck section is spaced apart from the second end of the second deck section by a second distance when in the second position, the second distance is greater than the first distance, the patient support further comprising an actuator coupled to the first deck section, the actuator being configured to move the first deck section between the first and second positions.

30. The patient support of claim 29, wherein the actuator is coupled to the second deck section.

31. The patient support of claim 29, wherein the coupler is configured to permit sliding of the first deck section relative to the second deck section during movement between the first and second positions.

32. The patient support of claim 31, wherein the coupler is configured to permit pivoting of the first deck section relative to the second deck section during movement between the first and second positions.

33. The patient support of claim 29, wherein the first and second deck sections are substantially coplanar when in the first position.

34. A patient support comprising a frame including an intermediate frame and a base frame supporting the intermediate frame, a deck positioned on the intermediate frame, the intermediate frame being movable relative to the base frame between a first position supporting the deck in a horizontal position and a second position supporting the deck in a non-horizontal position, the deck including a deck section configured to move between first and second positions relative to the frame, the intermediate frame including a pair of spaced-apart frame members including recessed portions configured to receive the deck section when in the second position, the recessed portions being spaced apart by a first distance, the deck section being positioned above the recessed portion of the spaced-apart frame members and including an outer width greater than or equal to the first distance, a mattress positioned on the deck, and wherein the deck includes another deck section and a coupler configured to couple a first end of one of the deck sections to a second end of the other deck section, the coupler is configured to coordinate movement of the deck sections during movement of the sections relative to the frame between first and second positions, the first end of the first deck section is spaced apart from the second end of the second deck section by a first distance when in the first position, the first end of the first deck section is spaced apart from the second end of the second deck section by a second distance when in the second position, the second distance is greater than the first distance, the patient support further comprising an actuator coupled to the first deck section, the actuator being configured to move the first deck section between the first and second positions.

35. The patient support of claim 34, wherein the actuator is coupled to the second deck section.

36. The patient support of claim 34, wherein the coupler is configured to permit sliding of the first deck section relative to the second deck section during movement between the first and second positions.

37. The patient support of claim 36, wherein the coupler is configured to permit pivoting of the first deck section relative to the second deck section during movement between the first and second positions.

38. The patient support of claim 34, wherein the first and second deck sections are substantially coplanar when in the first position.

39. A patient support comprising a frame including a concave portion defining a recess, a deck positioned on the frame, the deck including first and second deck sections configured to move relative to the frame between a first position and second position, the concave portion of the frame being configured to provide clearance for the first and second deck sections to move in the recess when moving between the first and second positions, a deck section actuator coupled to the deck sections to power movement of the deck sections relative to the frame, a mattress positioned on the deck, and wherein the deck further includes a coupler configured to couple a first end of the first deck section to a second end of the second deck section, the coupler is configured to coordinate movement of the first and second deck sections during movement of the first and second deck sections relative to the frame between the first and second positions, the first end of the first deck section is spaced apart from the second end of the second deck section by a first distance when in the first position, the first end of the first deck section is spaced apart from the second end of the second deck section by a second distance when in the second position, the second distance is greater than the first distance, the patient support further comprising an actuator coupled to the first deck section, the actuator being configured to move the first deck section between the first and second positions.

40. The patient support of claim 39, wherein the actuator is coupled to the second deck section.

41. The patient support of claim 39, wherein the coupler is configured to permit sliding of the first deck section relative to the second deck section during movement between the first and second positions.

42. The patient support of claim 41, wherein the coupler is configured to permit pivoting of the first deck section relative to the second deck section during movement between the first and second positions.

43. The patient support of claim 39, wherein the first and second deck sections are substantially coplanar when in the first position.

* * * * *